US012796845B2

(12) United States Patent
Luttrell et al.

(10) Patent No.: US 12,796,845 B2
(45) Date of Patent: Nov. 17, 2026

(54) BEDDING, METHOD OF MAKING, AND METHOD OF USING THE SAME

(71) Applicant: Standard Textile Co., Inc., Cincinnati, OH (US)

(72) Inventors: Amy M. Luttrell, Cincinnati, OH (US); Veronica L. Eastman, Cincinnati, OH (US); Melody A. Lambert, Cincinnati, OH (US); Kristin Kentie, Cincinnati, OH (US); Kelli Sharpe, Cincinnati, OH (US); Leslie Dressler, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 7 days.

(21) Appl. No.: 18/930,332

(22) Filed: Oct. 29, 2024

(65) Prior Publication Data

US 2025/0134282 A1 May 1, 2025

Related U.S. Application Data

(60) Provisional application No. 63/594,712, filed on Oct. 31, 2023.

(51) Int. Cl.
*A47G 9/02* (2006.01)

(52) U.S. Cl.
CPC ..... *A47G 9/0253* (2013.01); *A47G 9/0261* (2013.01)

(58) Field of Classification Search
CPC ..... A47G 9/0253; A47G 9/0261
See application file for complete search history.

(56) References Cited

U.S. PATENT DOCUMENTS

| | | | | | |
|---|---|---|---|---|---|
| 834,643 | A * | 10/1906 | Schnadig | A61F 5/485 | 5/490 |
| 5,084,928 | A * | 2/1992 | Skillington | A47G 9/0253 | 5/490 |
| 5,557,815 | A * | 9/1996 | Mintz | A47C 27/00 | 297/283.1 |
| 6,971,128 | B1 * | 12/2005 | McGrath | A47G 9/0261 | 5/490 |
| 8,448,275 | B1 * | 5/2013 | Leach | A47C 27/086 | 5/655 |

(Continued)

FOREIGN PATENT DOCUMENTS

| | | | |
|---|---|---|---|
| CN | 213075247 U | * | 4/2021 |
| CN | 217659095 U | * | 10/2022 |
| DE | 8802019 U1 | | 7/1988 |

OTHER PUBLICATIONS

European Patent Office, Extended Search Report issued in EP 24209788.9 dated Mar. 17, 2025.

*Primary Examiner* — David E Sosnowski
(74) *Attorney, Agent, or Firm* — Wood Herron & Evans LLP

(57) ABSTRACT

A bedding including pillowcases and duvet covers that are each configured to fit two different sized bed pillows or duvets, respectively. In one embodiment, a pillowcase defines a single or double open ended construction in which a first foldable flap and a second foldable flap on one or both ends of the pillowcase are configured to fold over and retain one of a designated and different sized pillow, such as a queen size pillow and a king size pillow, respectively, so that one pillowcase is able to receive and retain one of two different sized pillows.

15 Claims, 28 Drawing Sheets

(56) References Cited

U.S. PATENT DOCUMENTS

| | | | | |
|---|---|---|---|---|
| 9,226,605 | B1 * | 1/2016 | Castellano | A47G 9/0253 |
| 9,833,087 | B1 * | 12/2017 | Richardson | A47G 9/0253 |
| 10,548,420 | B2 * | 2/2020 | Cubbler | A47G 9/0253 |
| 10,980,365 | B1 * | 4/2021 | Ogden | A47G 9/0253 |
| 11,109,698 | B1 * | 9/2021 | Ogden | A47G 9/0253 |
| 11,206,936 | B2 * | 12/2021 | Lee | A47G 9/0223 |
| 11,272,797 | B1 * | 3/2022 | Ganushchak | A47G 9/0253 |
| 11,419,439 | B1 * | 8/2022 | Leach | A47G 9/0253 |
| 11,730,291 | B2 | 8/2023 | Maxfield et al. | |
| 2004/0031098 | A1 * | 2/2004 | Hollander | A47G 9/02 5/482 |
| 2005/0177941 | A1 * | 8/2005 | Miller | A47G 9/0253 5/490 |
| 2013/0042410 | A1 * | 2/2013 | Bice | A47G 9/007 5/490 |
| 2016/0007775 | A1 * | 1/2016 | Lusk | A47G 9/0253 5/490 |
| 2018/0303257 | A1 * | 10/2018 | Alletto, Jr. | A47G 9/0253 |
| 2019/0090668 | A1 * | 3/2019 | Hafeznezami | A47G 9/1081 |
| 2020/0154913 | A1 * | 5/2020 | Montes | A47G 9/0223 |
| 2021/0153670 | A1 * | 5/2021 | Maxfield | A47G 9/10 |
| 2021/0393057 | A1 * | 12/2021 | Yin | A47G 9/10 |
| 2023/0088919 | A1 * | 3/2023 | Williams | A45F 4/00 5/640 |
| 2025/0107646 | A1 * | 4/2025 | Angulo | A47G 9/0253 |
| 2025/0288136 | A1 * | 9/2025 | Rodgers | A47G 9/0253 |

* cited by examiner

BEDDING, METHOD OF MAKING, AND METHOD OF USING THE SAME

TECHNICAL FIELD

The present invention relates to bedding for use on a bed and, more specifically, to such bedding including pillowcases and duvet covers that are each configured to fit two different sized bed pillows or duvets, respectively, and a method of making and of using the bedding.

BACKGROUND

Facilities such as hotels can handle large volumes of launderable bedding, including pillow cases and duvet covers, on a regular daily basis. Significant time and energy can be expended in managing these types of linens, especially with respect to the sizes thereof. By way of example, differently-sized pillowcases, such as those for queen-sized pillows and king-sized pillows, can look alike when mixed together in the laundry process, and therefore laundry workers can spend a significant deal of time separating and sorting the pillowcases by size. In addition, even though pillowcases may be stored by size, housekeeping workers also can spend a significant amount of time verifying pillowcase sizes-both at a given storage location and during the room-to-room housekeeping process.

To help reduce the time for those who use or handle the bedding, such as pillowcases and duvet covers, one solution is adding a size indicator thereto. The size indicator is typically added as part of the forming process. By way of example, one area of the pillowcase, e.g., a hem, may be sewn with a certain/differently colored thread, rather than a white thread, for example, as may typically be used, to identify a specific size pillowcase. Differently sized pillowcases will have different color threads. As another example, size indication can be accomplished by including a yarn having a predetermined color as one of the warp or filling yarns during the weaving of the fabric (for the duvet cover, for example), with the color being correlated to an intended size of the bedding to be made therefrom. The yarn is positioned so that it will be visible in the formed bedding, so as to indicate the size thereof to those who subsequently handle the bedding. While these options may speed up the sorting process and housekeeping process to some extent, the bedding, e.g., pillowcases and duvet covers, ultimately must be identified and sorted by size.

It thus would be desirable to provide an improved bedding construction, such as for pillowcases and/or duvet covers, that still yet can help reduce the time for those who use or handle such bedding, particularly for those workers involved in separating and sorting.

SUMMARY OF THE INVENTION

The present invention relates to bedding including pillowcases and duvet covers that are each configured to fit two different sized bed pillows or duvets, respectively. The bedding, such as a pillowcase, defines a single or double open-ended construction in which a first foldable flap and a second foldable flap on one end or both ends of the bedding, respectively, are configured to fold over their respective open end and one another to retain therein one of a designated and different sized pillow or duvet, for example. In this manner, the pillowcase, for example, is able to receive and retain one of two different sized pillows (e.g., a queen size and a king size pillow) thereby allowing for the replacement of 2 SKUs with one SKU that fits 2 sizes of pillows. In addition, the bedding construction allows for a finished look regardless of whichever size pillow, for example, is being accommodated by hiding/covering the other unused foldable flap on that same end.

The double open-ended construction further provides an additional advantage of allowing housekeeping workers, for example, to load the pillowcase with a pillow more quickly and efficiently than a traditional single open-ended construction. The double open-ended construction allows one to reach into the pillowcase from the open end opposite where the pillow is being inserted, and then grab and more easily pull the pillow through the other open as compared to the traditional pushing or stuffing of the pillow from the one open end only.

A clean and attractive finished appearance is provided when the pillow is properly situated therein.

In one embodiment, a bedding is provided that includes a generally rectangular shape with opposing edges extending along in parallel relationship, a closed end, and a first open end opposite the closed end, a first length that is defined by the distance between an edge of the closed end of the bedding and a distal end of a first foldable flap, which is situated on a first side of the bedding and that extends beyond a second foldable flap on a second opposing and shorter side of the bedding. The bedding further includes a second length that is shorter than the first length and defined by the distance between the same edge of the closed end and a distal end of the second foldable flap that is situated on the second opposing and shorter side of the bedding, the first and second foldable flaps are situated on the opposite first and second sides of the bedding, respectively, and about a first opening at the first open end, which is opposite the closed end and leads to a cavity into which a pillow or duvet can be received, each foldable flap overlaps a portion of each corresponding side by a desired length. The bedding defines a single open-ended construction in which the first foldable flap and the second foldable flap on one end of the bedding is configured to individually fold over their respective first open end and one another to retain and hide therein one of a designated and different sized pillow or duvet dependent upon which foldable flap is folded over the other. In one example, the bedding is a pillowcase that accommodates two different sized pillows. In another example, the bedding is a duvet cover that accommodates two different sized duvets.

In another embodiment, bedding defines a double open-ended construction in which the closed end of the bedding is replaced with a second opening that defines a second open end opposite the first opening and first open end and in which a third foldable flap is situated on the second end of the bedding and configured to fold over its respective second opening to retain and hide therein along with the first and second foldable flaps one of the designated and different sized pillow or duvet, and either wherein the first length is defined by a distance between the distal end of the first foldable flap, which is situated on the first side of the bedding and that extends beyond the second foldable flap on the second opposing side, and a distal end of the third foldable flap, which is situated on the second side of the bedding, or wherein the second length is defined by the distance between the distal end of the second foldable flap and a distal end of the third foldable flap, both of which are situated on the same side of the bedding.

In another embodiment, the bedding defines a double open-ended construction in which the closed end of the bedding is replaced with a second opening that defines a second open end opposite the first opening and first open end and in which a third foldable flap and a fourth foldable flap are oppositely situated on the second end of the bedding and are configured to individually fold over their respective second open end and one another to retain and hide therein along with the first and second foldable flaps one of the designated and different sized pillow or duvet, wherein the first length is defined by a distance between the distal end of the first foldable flap, which is situated on the first side of the bedding and that extends beyond the second foldable flap on the second opposing side, and a distal end of the third foldable flap, which is situated on the first side and that extends beyond the fourth foldable flap on the second opposing side of the bedding, and wherein the second length is defined by the distance between the distal end of the second foldable flap and a distal end of the fourth foldable flap, both of which are situated on the second side of the bedding.

In yet another embodiment, a method of making a bedding is provided that includes sewing a hem for each of a first and second foldable flap on opposite ends of a piece of fabric having a length and a width that is rectangular in shape. Thereafter, a desired length of the opposite ends of the fabric, which includes each of the hems, is folded back over along its length and across its width onto the fabric so as to create each of the first and second foldable flaps. Thereafter, a length of the fabric is folded over along its length and across its width so that a side with the first foldable flap can be overlapped in part and situated adjacent a side with the second foldable flap, wherein the side with the first foldable flap has a first length to generally correspond to a first pillow or first duvet, and the side with the second foldable flap has a second shorter length to generally correspond to a second different sized pillow or second duvet. Then, stitching occurs along opposing edges of the fabric including those of a closed end to secure opposing sides of the fabric to form the bedding, which includes a first open end having a first opening opposite the closed end, and wherein the bedding is situated in an inside out position. In another embodiment, bedding is turned right side out, wherein the bedding defines a single open-ended construction in which the first foldable flap and the second foldable flap on one end of the bedding is configured to individually fold over their respective first open end and one another to retain and hide therein one of a designated and different sized pillow or duvet dependent upon which foldable flap is folded over the other.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1A:
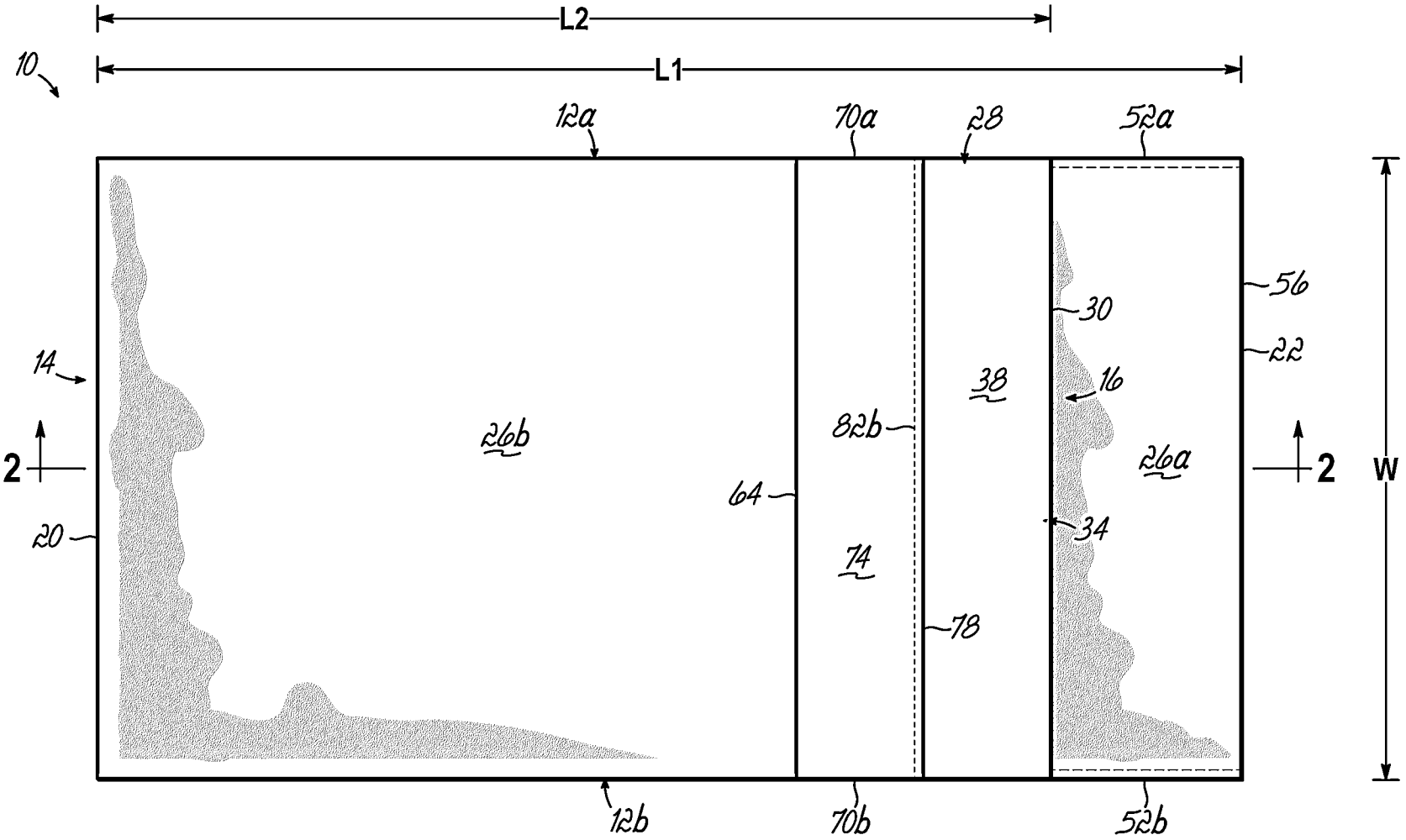
FIGS. 1A and 1B are top and bottom plan views, respectively, of a pillowcase in accordance with an embodiment of the invention.

With reference to FIGS. 1A-3, bedding is shown here that takes the form of a pillowcase 10 in accordance with one embodiment of the invention that defines a single open-ended pillowcase construction. The pillowcase 10 here is generally rectangular in shape and has opposing edges 12*a* and 12*b* extending along in parallel relationship, a closed end 14, and an open end 16 opposite the closed end. The pillowcase 10 includes an overall first length (L1) that is defined by the distance between an edge 20 of the closed end 14 of the pillowcase 10 and a distal end 22 of a first foldable flap 24, which is situated on a first side 26*a* of the pillowcase 10 and that extends beyond a second foldable flap 28 on a second opposing side 26*b* of the pillowcase. The pillowcase further includes a second shorter length (L2) that is defined by the distance between the same edge 20 of the closed end 14 and a distal end 30 of the second foldable flap 28 that is situated on the second shorter side 26*b* of the pillowcase 10.

The first and second foldable flaps 24, 28 are situated on opposite sides 26*a*, 26*b* of the pillowcase 10 and about an opening 34 (FIG. 3) at the open end 16 thereof, which is opposite the closed end 14. Each flap 24, 28 extends along the width (W) of the pillowcase 10 from one edge 12*a* to the other edge 12*b* and overlaps a portion of each corresponding side 26*a*, 26*b* by a desired length. The width (W) of the pillowcase is shown as being generally uniform along the lengths L1, L2 thereof. Each flap 24, 28 further includes an outer surface 36 and 38, respectively, that faces away from the pillowcase 10 and an inner surface 40 and 42, respectively, that faces towards the pillowcase 10 and that is situated adjacent an outer surface of its respective side 26*a*, 26*b* of the pillowcase 10. The opening 34 of the pillowcase 10 leads to a cavity 44 (FIGS. 5 and 7) into which a pillow can be placed/received and ultimately retained therein by at least one of the first or second foldable flaps 24, 28 when folded over. Accordingly, this pillowcase configuration can allow for receipt of two differently sized pillows 48 (FIG. 5) and 50 (FIG. 7) generally corresponding to the first and second lengths (L1 and L2) and the width (W) of the pillowcase 10. In particular, a first pillow size defined by the first pillow 48 can correspond generally to the width W and first length L1, and a second pillow size defined by the second pillow 50 can correspond generally to the width W and second length L2. In another example, the first pillow 48 and the second pillow 50 can be of the same width, which is about the same size as or less than the width W of the pillowcase 10, with the first pillow 48 having a length that is greater than the second length L2 but about or less than the first length L1 and the second pillow 50 being about or less than the second length L2. In one example, the first pillow 48 can be a king sized pillow and the second pillow 50 can be a queen sized pillow.

With continuing reference to FIGS. 1A-3, opposing edges 52*a* and 52*b* of the first foldable flap 24 are shown aligned with the edges 12*a*, 12*b* of the pillowcase 10 and can be sewn theretogether along a length of the first foldable flap 24 by means and methods known in the art. The distal end 22 of the first foldable flap 24 is continuous with a terminal end 56 of the corresponding side 26*a* of the pillowcase 10 thereby generally defining a continuous hinge along the width W of the pillowcase 10 about which the foldable flap 24 may pivot/may be folded over. A hem 58 can be sewn into a proximal end 60 of the first foldable flap 24 along its width by means and methods known in the art.

Figure 2:
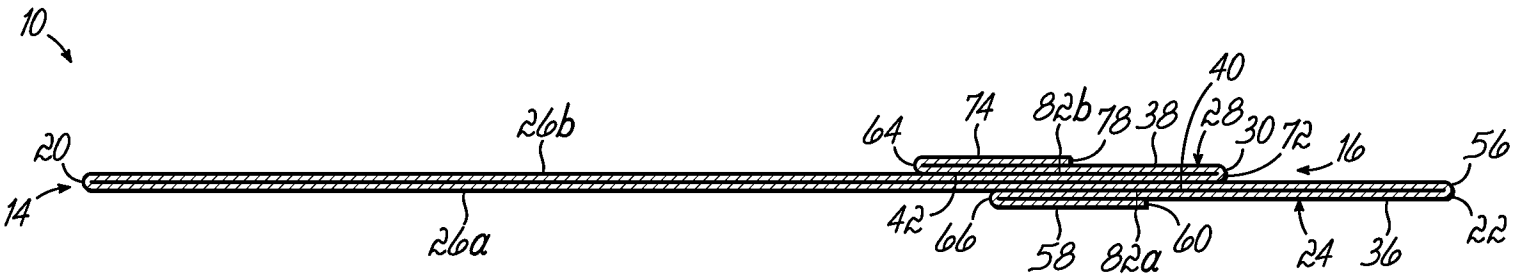
FIG. 2 is a cross-sectional view of the pillowcase of FIG. 1 taken along lines 2-2.
Figure 3:
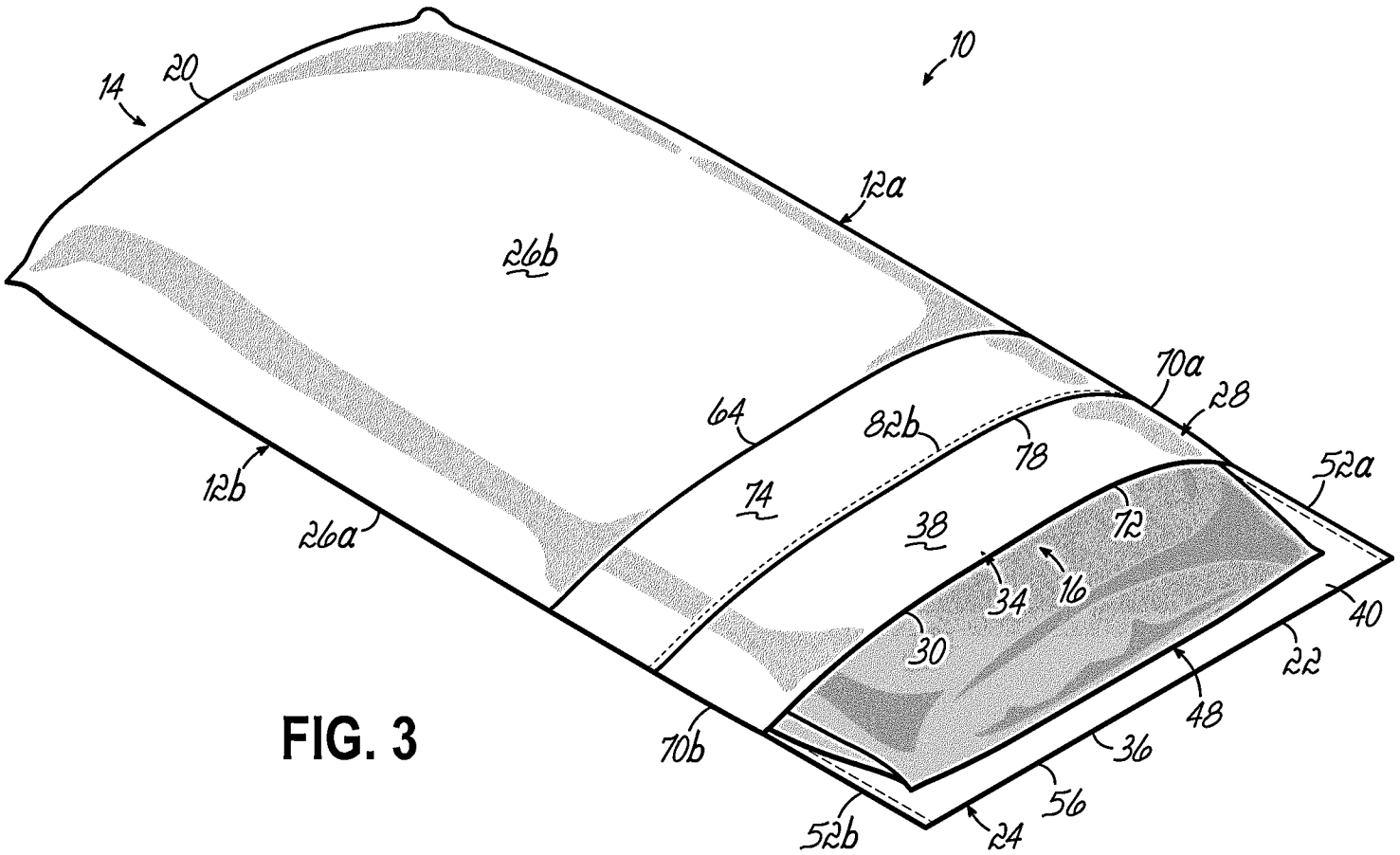
FIG. 3 is a perspective view of the pillowcase of FIG. 1 with a pillow inserted therein but not yet secured by one of the foldable flaps.
Figure 4:
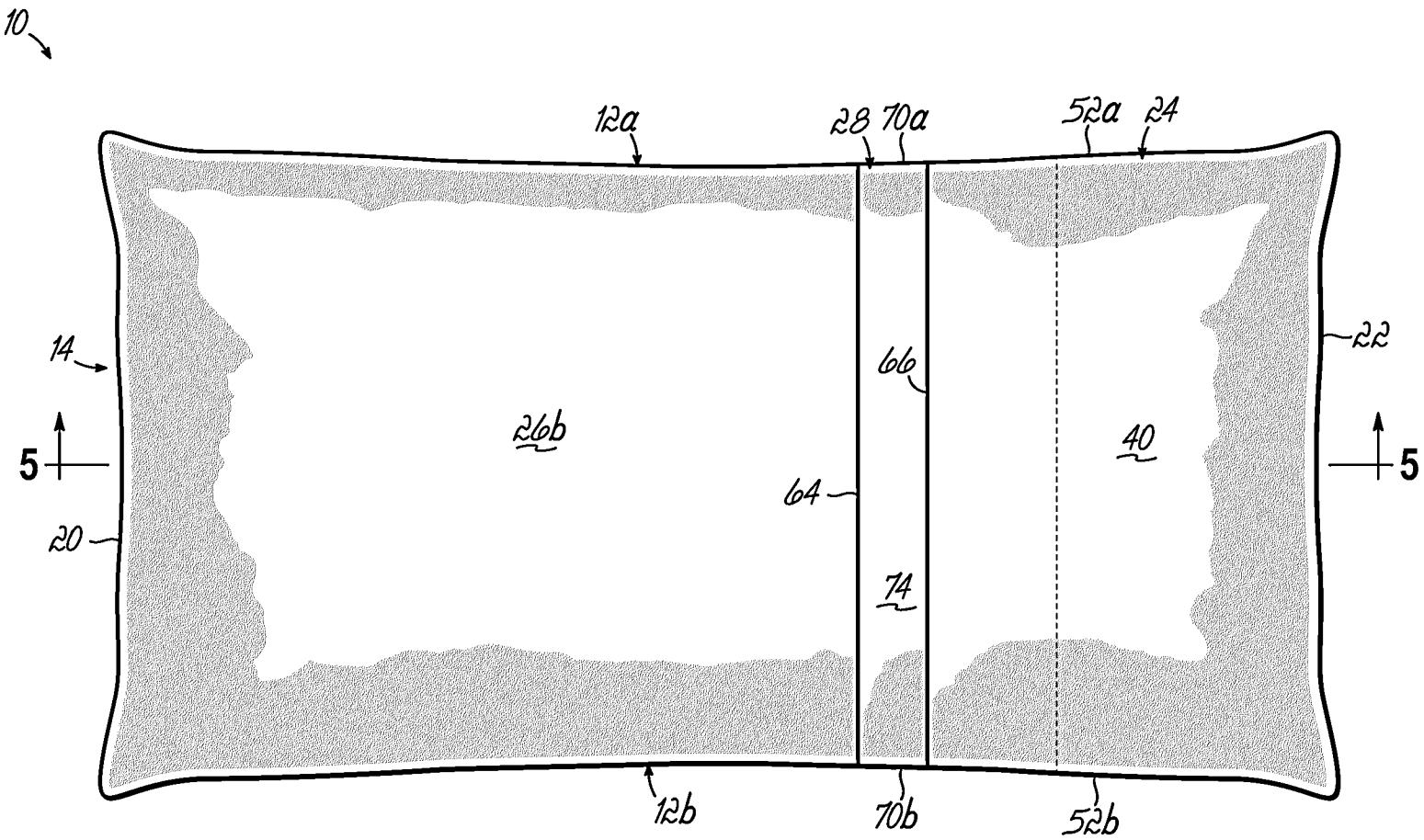
FIG. 4 is a top plan view of the pillowcase of FIG. 3 with one of the foldable flaps folded over the end of the pillow to secure the pillow therein.
Figure 5:
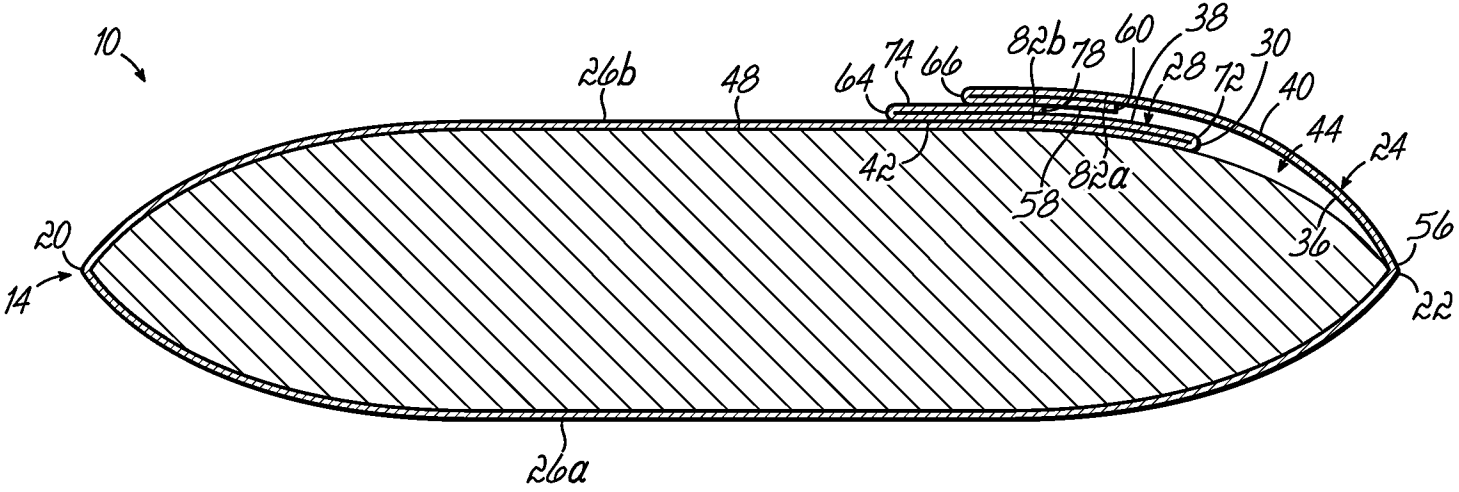
FIG. 5 is a cross-sectional view of the pillowcase with pillow of FIG. 4 taken along lines 5-5.

As best shown in FIGS. 4 and 5, due to the construction of the first foldable flap 24, the flap 24 may be lifted up and folded over the opening 34 and at least a portion of the second foldable flap 28 to thereby essentially close the open end 16 of the pillowcase 10 and retain the first sized pillow 48, which may be a king sized pillow, for example. More specifically, the first foldable flap 24 is lifted up and folded over along the hinge formed by the intersection of the distal end 22 of the first foldable flap 24 and the terminal end 56 of the corresponding side 26*b* of the pillowcase 10. In the closed position, the inner surface 40 of the first foldable flap 24 is now exposed and the outer surface 36 faces the pillowcase 10 covering a portion of the second foldable flap 28 to provide to provide a finished look for the pillowcase 10. This fold over process can be reversed to expose the pillow 48 and allow for its removal from the cavity 44. Although the second foldable flap 28 includes a proximal edge 64 that is shown in FIG. 2, for example, that is situated below a proximal edge 66 of the first foldable flap 24, it should be understood that the opposite can occur. That is the proximal edge 64 of the second foldable flap 28 may be positioned above the proximal edge 66 of the first foldable flap 24. This merely results in a change in the finished look of the pillowcase 10 when the flaps 24, 28 are folded over to retain their correspondingly sized pillows 48, 50.

Similarly, opposing edges 70*a* and 70*b* of the second foldable flap 28 can be aligned with the edges 12*a*, 12*b* of the pillowcase 10 and can be sewn theretogether along a length of the second foldable flap 28 by means and methods known in the art. The distal end 30 of the second foldable flap 28 is continuous with a terminal end 72 of the corresponding side 26*b* of the pillowcase 10, which is opposite that of the first foldable flap 24, thereby generally defining a continuous hinge along the width W of the pillowcase 10 about which the foldable flap 28 may pivot/may be folded over. A hem 74 can be sewn into a proximal end 78 of the second foldable flap 28 along its width by means and methods known in the art.

Figure 6:
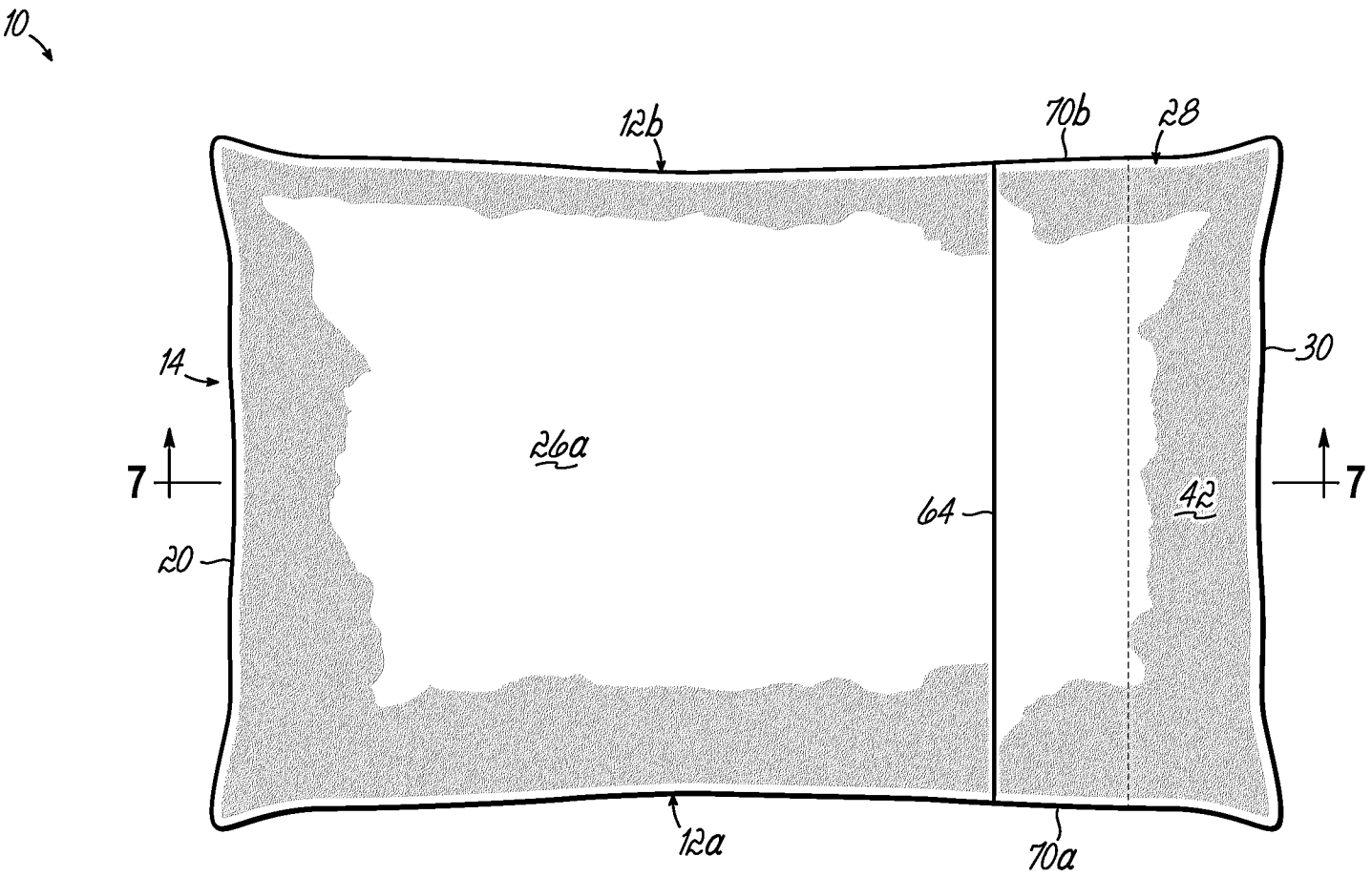
FIG. 6 is a top plan view of the pillowcase of FIG. 1 with a smaller sized pillow inserted in the pillowcase and the other of the foldable flaps folded over the end of the pillow to secure the pillow therein.
Figure 7:
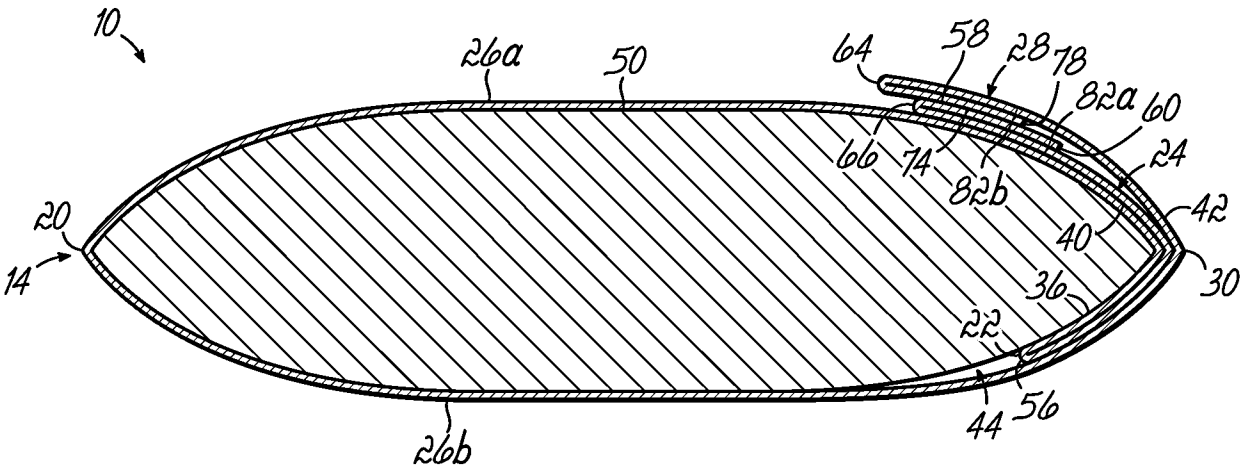
FIG. 7 is a cross-sectional view of the pillowcase with pillow of FIG. 6 taken along lines 7-7.

As best shown in FIGS. 6 and 7, due to the construction of the second foldable flap 28, the flap 28 may be lifted up and folded over the opening 34 and at least a portion of the first foldable flap 24 to thereby essentially close the open end 16 of the pillowcase 10 and retain the second sized pillow 50, which may be a queen sized pillow. More specifically, the second foldable flap 28 is lifted up and folded over along the hinge formed by the intersection of the distal end 30 of the second foldable flap 28 and the terminal end 72 of the corresponding side 26*b* of the pillowcase. In the closed position, the inner surface 42 of the second foldable flap 28 is now exposed and the outer surface 38 faces the pillowcase 10 covering at least a portion of the first foldable flap 24 to provide a finished look. The extra length of the pillowcase 10, including the portion of first foldable flap 24 and corresponding side 26*b* thereof extending beyond the second foldable flap 28, is shown placed over an end of the pillow 50 and underneath the second foldable flap 28 and a portion of its corresponding side 26*a*, and is hidden from view while covering the opening 34 and helping the second foldable flap to retain the pillow 50 in the cavity 44. Here, the pillowcase 10 is configured to be able to hide the extra fabric for the king size option when used on a queen sized pillow. It is contemplated that other folding configurations for the extra fabric may be utilized other than as shown here. This fold over process can be reversed to expose the pillow 50 and allow for its removal from the cavity 44.

Accordingly, the first and second foldable flaps 24, 28 are configured to generally fold over the opening 34 and one another when a pillow 48, 50 of a certain size is received in the pillow cavity 44 and, thus, retain that certain sized pillow, such as a king sized pillow or a queen sized pillow, respectively.

With reference again to FIGS. 1A-3, the first and second foldable flaps 24, 28 can include one or more colored yarns 82*a* and 82*b* to designate the different sized pillows 48, 50 that each flap 24, 28 can accommodate. For example, the hem 58 of the first foldable flap 24 may be sewn with a certain colored thread 82*a*, such as a blue thread, to identify the king sized flap 24, and the hem 74 of the second foldable flap 28 may be sewn with another colored thread 82*b*, such as a red thread, to identify the queen sized flap 28, with both colors, for example, being different than the primary/main color of the pillowcase 10 itself. In another example, the queen size can be designated by a blue colored thread and the king size can be designated by a green or white colored thread. The thread color can be on the outer surface 36, 38 of the flap 24, 28, inner surface 40, 42 of the flap 24, 28, or both. As another example, size indication can be accomplished by including a yarn having a predetermined color as one of the warp or filling yarns during the weaving of the fabric for the pillowcase 10, with the color being correlated to an intended size of the pillow. The yarn is positioned so that it will be visible in the formed foldable flaps 24, 28, so as to indicate the size thereof to those who subsequently handle the pillowcase 10. In general, any color combination (s) can be utilized, as desired, including green, blue, white, yellow, red, orange, mauve, gold, purple, and the like.

With reference now to FIGS. 8A-10, a pillowcase 100 is shown in accordance with another embodiment of the invention that defines a double open-ended pillowcase construction. In contrast with the single open-ended construction of the pillowcase 10 as shown in FIGS. 1A-3, for example, this pillowcase 100 replaces the closed end 14 of pillowcase 10 with a second opening 134*b* that defines a second open end 116*b* opposite a first opening 134*a* having a first open end 116*a*. The pillowcase 100 here is generally rectangular in shape and has opposing edges 112*a* and 112*b* extending along in parallel relationship, the first open end 116*a*, and the second open end 116*b* opposite the first open end 116*a*. The pillowcase 100 includes an overall first length (L1) that is defined by the distance between a distal end 122 of a first foldable flap 124, which is situated on the first side 126*a* of the pillowcase 100 and that extends beyond a second foldable flap 128 on a second opposing side 126*b* of the pillowcase 100, and a distal end 122 of a third foldable flap 127, which also is situated on the first side 126*a* of the pillowcase 100 and that extends beyond a fourth foldable flap 129 on the second opposing side 126*b* of the pillowcase 100. The pillowcase further includes a second shorter length (L2) that is defined by the distance between a distal end 130 of the second foldable flap 128 and a distal end 130 of the fourth foldable flap 129, both of which are situated on the second side 126*b* of the pillowcase 100.

The first and second foldable flaps 124, 128 are situated on opposite sides 126*a*, 126*b* of the pillowcase and about opening 134*a* at the first open end 116*a* thereof, which is opposite the second open end 116*b*. Similarly, the third and fourth foldable flaps 127, 129 are situated on opposite sides 126*a*, 126*b* of the pillowcase 100 and about opening 134*b* at the second open end 116*b* thereof. Each flap 124, 127, 128, 129 extends along the width (W) of the pillowcase 100 from one edge 112*a* to the other edge 112*b* and overlaps a portion of each corresponding side 126*a*, 126*b* by a desired length. The width (W) of the pillowcase 100 again is generally uniform along the lengths L1, L2 thereof. Each of the first and third flaps 124, 127, and the second and fourth flaps 128 and 129 further include an outer surface 136 and 138, respectively, that faces away from the pillowcase 100 and an inner surface 140 and 142, respectively, that faces towards the pillowcase 100 and that is situated adjacent an outer surface of its respective side 126*a*, 126*b* of the pillowcase 100. The openings 134*a*, 134*b* of the pillowcase 100 lead to a cavity 144 (FIGS. 12 and 14) into which a pillow can be placed/received and ultimately retained therein by at least one of the first and third flaps 124, 127 or second and fourth foldable flaps 128, 129 when folded over. Accordingly, like the pillowcase 10 of FIGS. 1A-3, this pillowcase configuration allows for receipt of two differently sized pillows 48 (FIG. 12) and 50 (FIG. 14) generally corresponding to the first and second lengths (L1 and L2) and the width (W) of the pillowcase 100.

Here, corresponding flaps 124 and 127 and 128 and 129 on both of the open ends 116*a*, 116*b* of the pillowcase 100 cooperate to enclose and retain a certain sized pillow. In particular, a first pillow size defined by the first pillow 48 can correspond generally to the width W and first length L1, and a second pillow size defined by the second pillow 50 can correspond generally to the width W and second length L2. In another example, the first pillow 48 and second pillow 50 can be of the same width, which is about the same size as or less than the width W of the pillowcase, with the first pillow 48 having a length that is greater than the second length L2 but about or less than the first length L1 and the second pillow 50 being about or less than the second length L2. In one example, the first pillow 48 can be a king sized pillow and the second pillow 50 can be a queen sized pillow. The double open-ended construction allows one to reach into the cavity 144 of the pillowcase 100 from the first or second open end 116*a*, 116*b* opposite where the pillow 48, 50 is being inserted, and then grab and more easily pull the pillow 48, 50 through the other open end as compared to the traditional pushing or stuffing of the pillow 48, 50 from the one open end only.

With continuing reference to FIGS. 8A-10, opposing edges 152*a* and 152*b* of the first and third foldable flaps 124, 127 are shown aligned with the edges 112*a*, 112*b* of the pillowcase 100 and can be sewn theretogether along a length of the first and third foldable flaps 124, 127 by means and methods known in the art. The distal end 122 of the first and third foldable flap 124, 127 is continuous with a terminal end 156 of the corresponding side 126*a* of the pillowcase 100 thereby generally defining a continuous hinge along the width W of the pillowcase 100 about which the foldable flaps 124, 127 may pivot/may be folded over. A hem 158 can be sewn into a proximal end 160 of the first and third foldable flaps 124, 127 along their width by means and methods known in the art.

Figure 9:
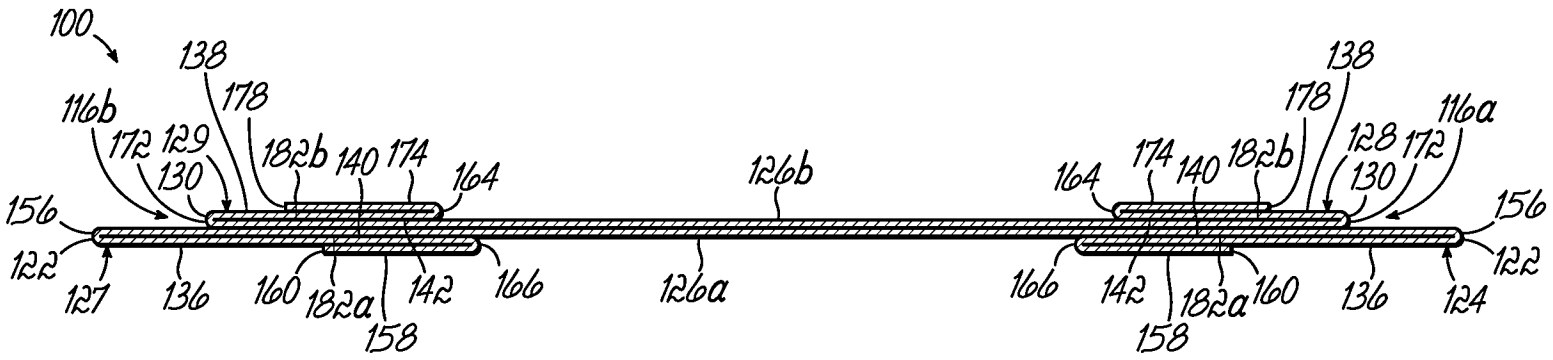
FIG. 9 is a cross-sectional view of the pillowcase of FIG. 8A taken along lines 9-9.
Figure 10:
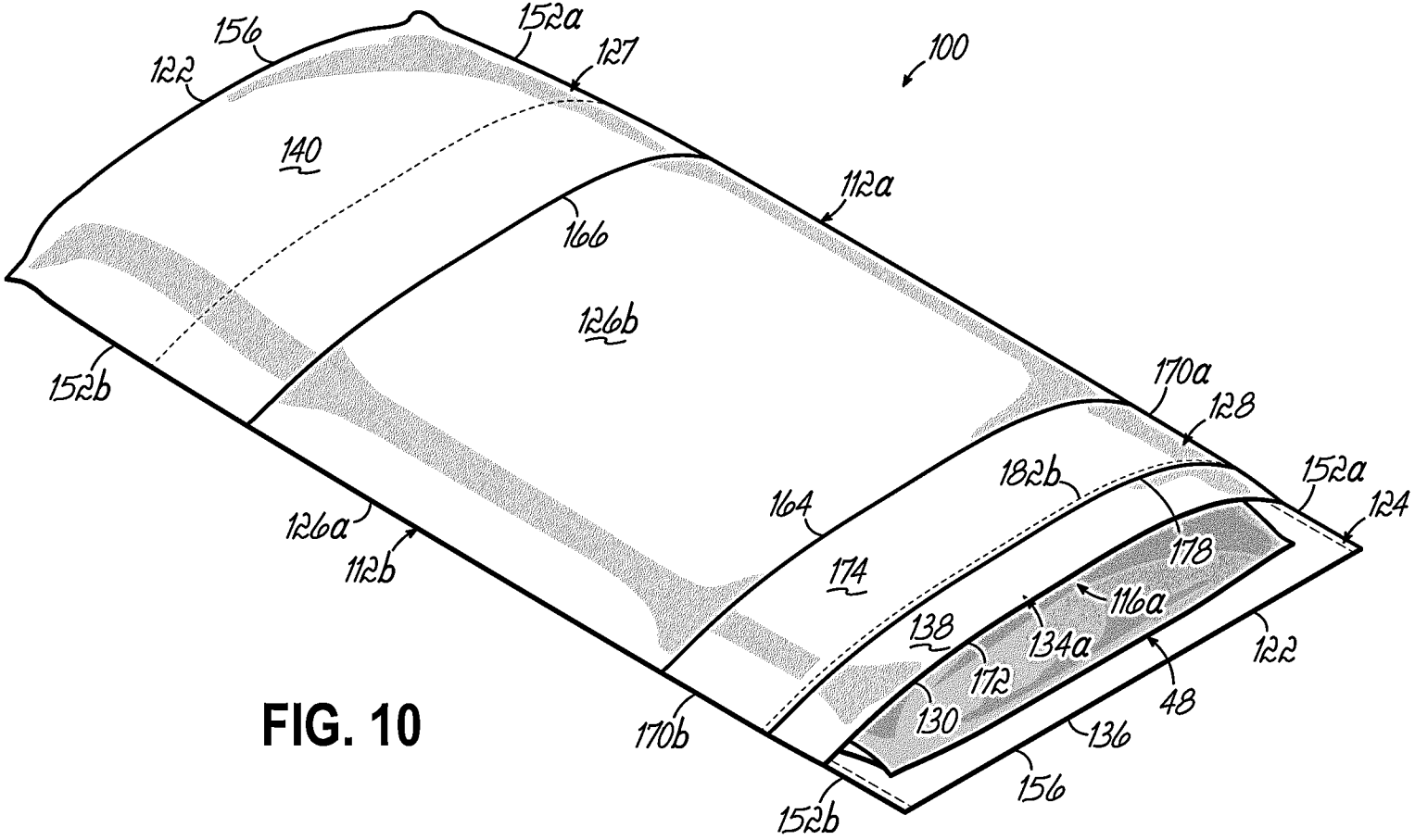
FIG. 10 is a perspective view of the pillowcase of FIG. 8A with a pillow inserted therein shown partially but not yet fully secured by the foldable flaps.
Figure 11:
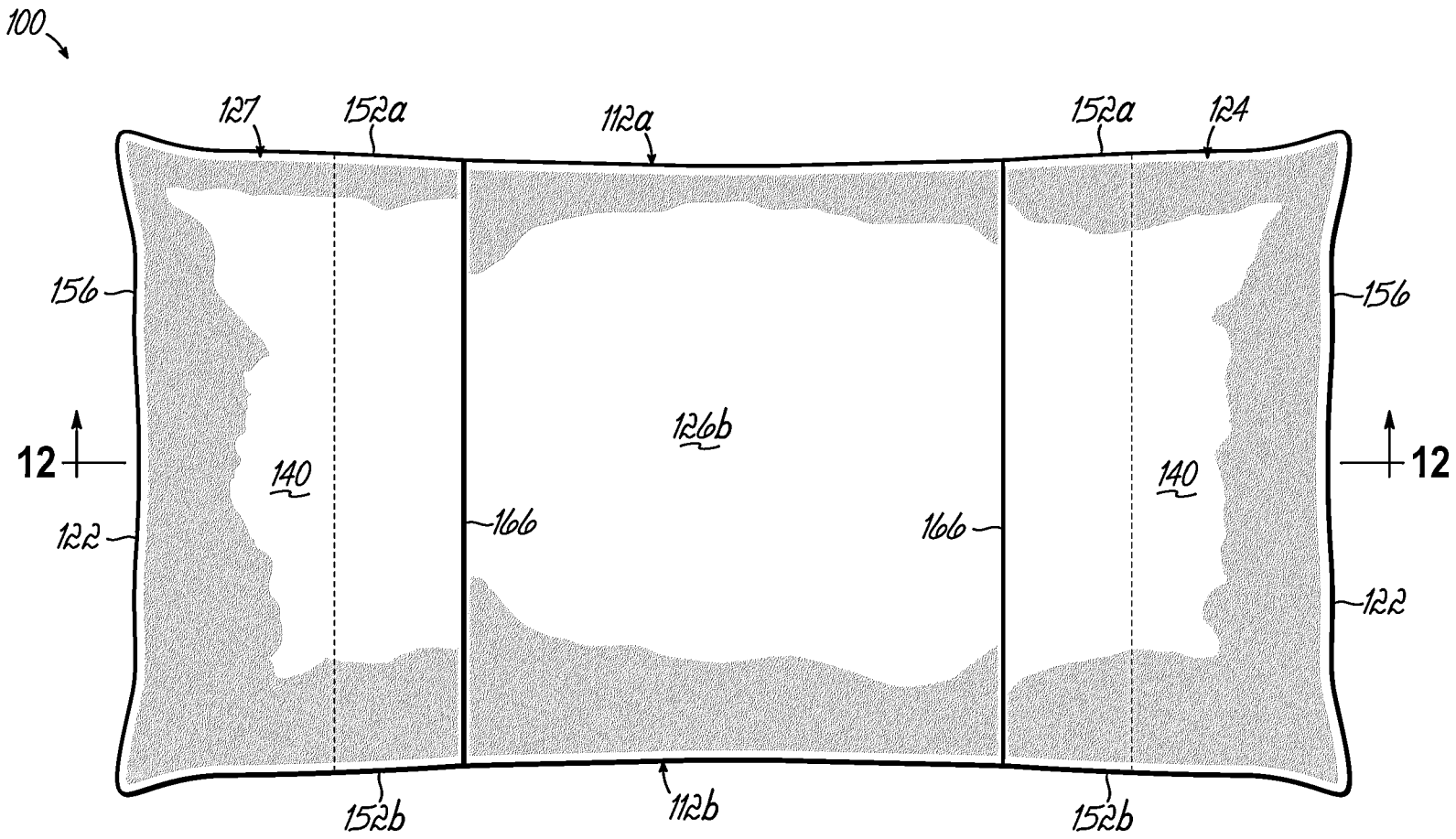
FIG. 11 is a top plan view of the pillowcase of FIG. 10 with two of its foldable flaps folded over the first and second ends of the pillowcase to secure the pillow therein.
Figure 12:
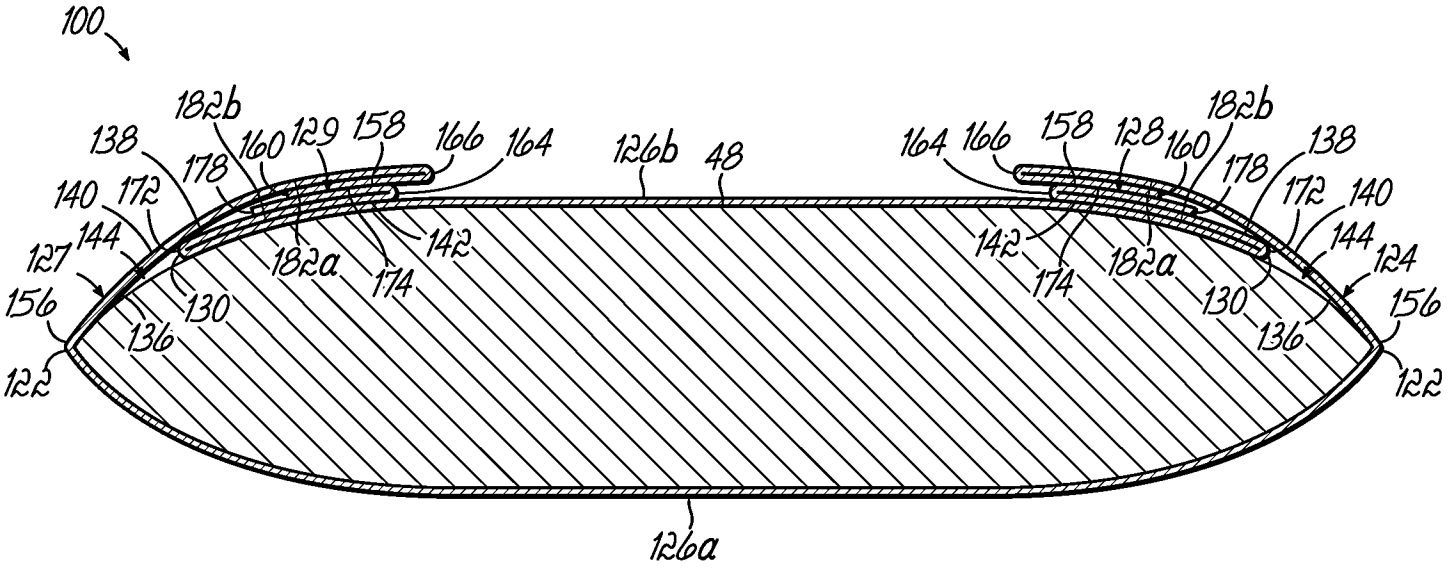
FIG. 12 is a cross-sectional view of the pillowcase with the pillow of FIG. 11 taken along lines 12-12.

As best shown in FIGS. 11 and 12, due to the construction of the first and third foldable flaps 124, 127, the flaps 124, 127 may be lifted up and folded over their respective opening 116*a*, 116*b* and at least a portion of the second and fourth foldable flaps 128, 129, respectively, to thereby essentially close the first and second open ends 116*a*, 116*b* of the pillowcase 100 and retain the first sized pillow 48, which may be a king sized pillow, for example. More specifically, the first and third foldable flaps 124, 127 are lifted up and folded over along the hinges formed by the intersection of the distal ends 122 of the first and third foldable flaps 124, 127 and the terminal ends 156 of the corresponding side 126*a* of the pillowcase. In the closed position, the inner surfaces 140 of the first and third foldable flaps 124, 127 are now exposed and the outer surfaces 136 face the pillowcase 100 covering at least a portion of the second and fourth foldable flaps 128, 129 to provide a finished look for the pillowcase 100. Here, the second and fourth foldable flaps 128, 129 are shown hidden from view. This fold over process can be reversed for either or both of the first and third foldable flaps 124, 127 to expose the pillow 48 and allow for its removal from the cavity 144. Although the second and fourth foldable flaps 128, 129 include a proximal edge 164 that is shown in FIG. 9, for example, that is situated above a proximal edge 166 of the first and third foldable flaps 124, 127, it should be understood that the opposite can occur. That is, the proximal edge 164 of the second and fourth foldable flap 128, 129 may be positioned below the proximal edge 166 of the first and third foldable flaps 124, 127. This merely results in a change in the finished look of the pillowcase 100 when the flaps 124, 127, 128, 129 are folded over to retain their correspondingly sized pillows 48, 50.

Similarly, opposing edges 170*a* and 170*b* of the second and fourth foldable flaps 128, 129 can be aligned with the edges 112*a*, 112*b* of the pillowcase 100 and can be sewn theretogether along a length of the second and fourth foldable flaps 128, 129 by means and methods known in the art. The distal ends 130 of the second and fourth foldable flap 124, 127 is continuous with a terminal end 172 of the corresponding side 126*b* of the pillowcase 100, which is opposite that of the first and third foldable flaps 124, 127, thereby generally defining a continuous hinge along the width W of the pillowcase 100 about which the foldable flaps 128, 129 may pivot/may be folded over. A hem 174 can be sewn into a proximal end 178 of the second and fourth foldable flaps 128, 129 along their width by means and methods known in the art.

Figure 13:
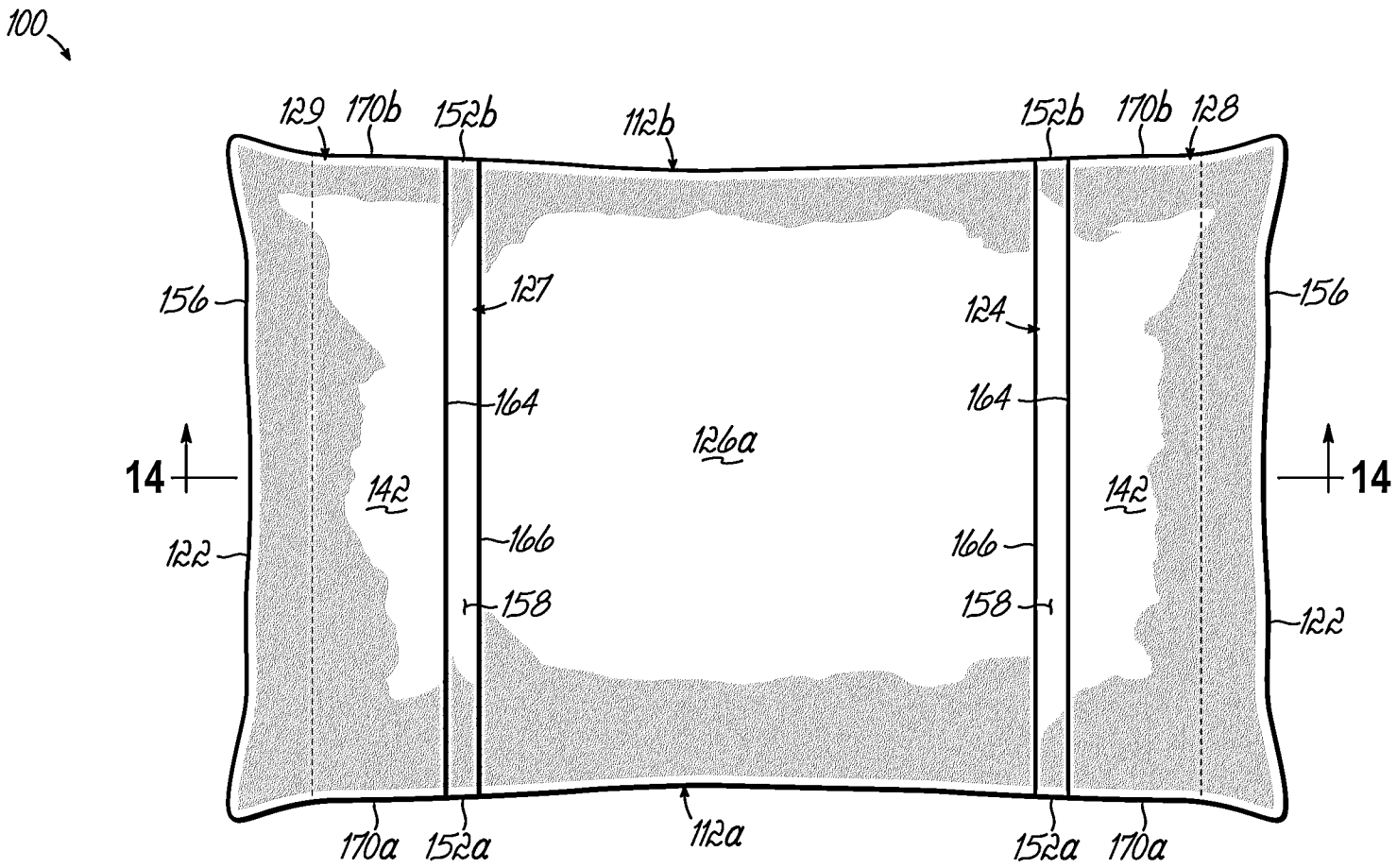
FIG. 13 is a top plan view of the pillowcase of FIG. 8A with a smaller sized pillow inserted in the pillowcase and the other of the foldable flaps folded over the ends of the pillow to secure the pillow therein.
Figure 14:
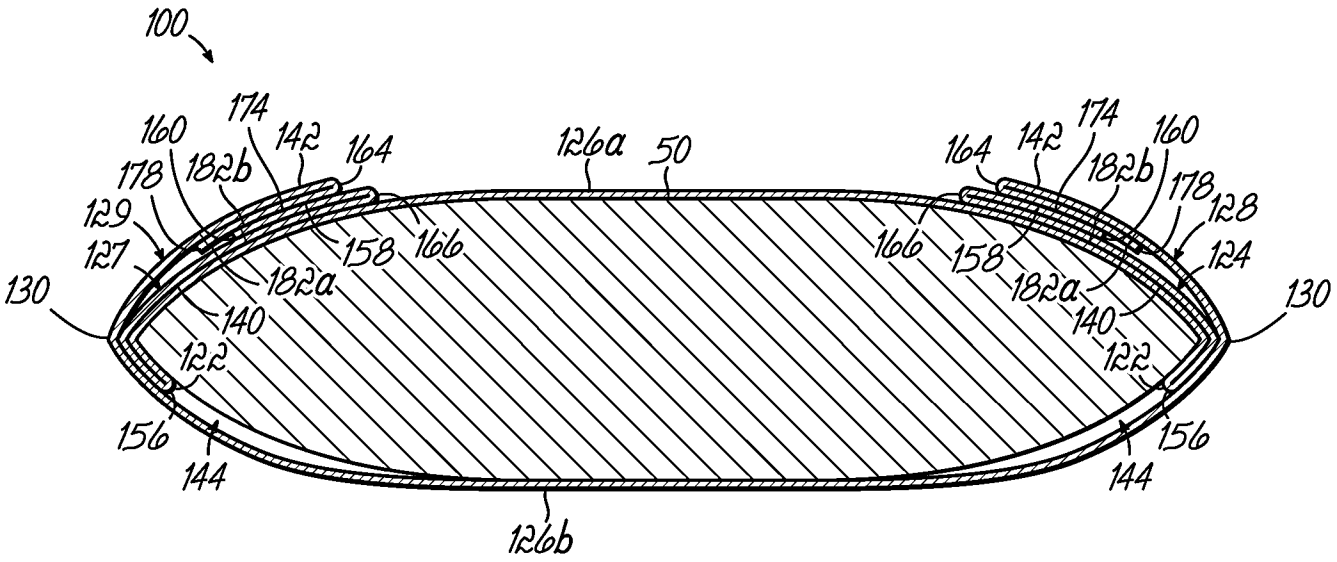
FIG. 14 is a cross-sectional view of the pillowcase with pillow of FIG. 13 taken along lines 14-14.

As best shown in FIGS. 13 and 14, due to the construction of the second and fourth foldable flaps 128, 129, the flaps may be lifted up and folded over their respective opening 134*a*, 134*b* and at least a portion of the first and third foldable flaps 124, 127, respectively, to thereby essentially close the first and second open ends 116*a*, 116*b* of the pillowcase 100 and retain the second sized pillow 50, which may be a queen sized pillow. More specifically, the second and fourth foldable flaps 128, 129 are lifted up and folded over along the hinges formed by the intersection of the distal end 130 of the second and fourth foldable flaps 128, 129 and the terminal end 172 of the corresponding side 126*b* of the pillowcase. In the closed position, the inner surface 142 of the second and fourth foldable flaps 128, 129 are now exposed and the outer surfaces 138 face the pillowcase 100 covering at least a portion of the first and third foldable flaps 124, 127 to provide a finished look. In particular, the extra length of the pillowcase 100, including the portion of the first and third foldable flaps 124, 127 and corresponding side 126*b* thereof extending beyond the second and fourth foldable flaps 128, 129 is shown placed over corresponding ends of the pillow 50 and underneath the second and fourth foldable flaps 128, 129 and a portion of its corresponding side 126*a*, and is hidden from view while covering the opening 134 and helping the second and fourth foldable flaps 128, 129 to retain the pillow 50 in the cavity 144. The first and third foldable flaps 124, 127 are shown partially hidden from view and partially viewable to provide a tiered look. Here, the pillowcase 100 is configured to be able to hide the extra fabric for the king size option when used on a queen sized pillow. It is contemplated that other folding configurations for the extra fabric may be utilized other than as shown here. This fold over process can be reversed to expose the pillow 50 and allow for its removal from the cavity 144.

Accordingly, the first and third foldable flaps 124, 127 and second and fourth foldable flaps 128, 129 are configured to generally fold over their corresponding openings 134*a*, 134*b* and one another when a pillow 48, 50 of a certain size is received in the pillow cavity 144 and, thus, retain that certain sized pillow, such as a king sized pillow or a queen sized pillow, respectively.

As discussed above with respect to FIGS. 1A-3, the foldable flaps 124, 127, 128, 129 of FIGS. 8A-10 can include one or more colored yarns 182*a* and 182*b* to designate the different sized pillows 48, 50 that the flaps 124, 127, 128, 129 can accommodate. For example, the hem 158 of the first and third foldable flap 124, 127, which cooperate together, may be sewn with a certain colored thread 182*a*, such as a blue thread, to identify the king sized flaps 124, 127, and the hem 174 of the second and fourth foldable flaps 128, 129, which also cooperate together, may be sewn with another colored thread 182*b*, such as a red thread, to identify the queen sized flaps 128, 129, with both colors, for example, being different than the primary/main color of the pillowcase 100 itself. In another example, the queen size can be designated by a blue colored thread and the king size can be designated by a green or white colored thread. The thread color can be on the outer surface 136, 138 of the flaps 124, 127, 128, 129, inner surface 140, 142 of the flaps 124, 127, 128, 129, or both. As another example, size indication can be accomplished by including a yarn having a predetermined color as one of the warp or filling yarns during the weaving of the fabric for the pillowcase 100, with the color being correlated to an intended size of the pillow. The yarn is positioned so that it will be visible in the formed foldable flaps 124, 127, 128, 129, so as to indicate the size thereof to those who subsequently handle the pillowcase 100. In general, any color combination(s) can be utilized, as desired, including green, blue, white, yellow, red, orange, mauve, gold, purple, and the like.

Figure 8A:
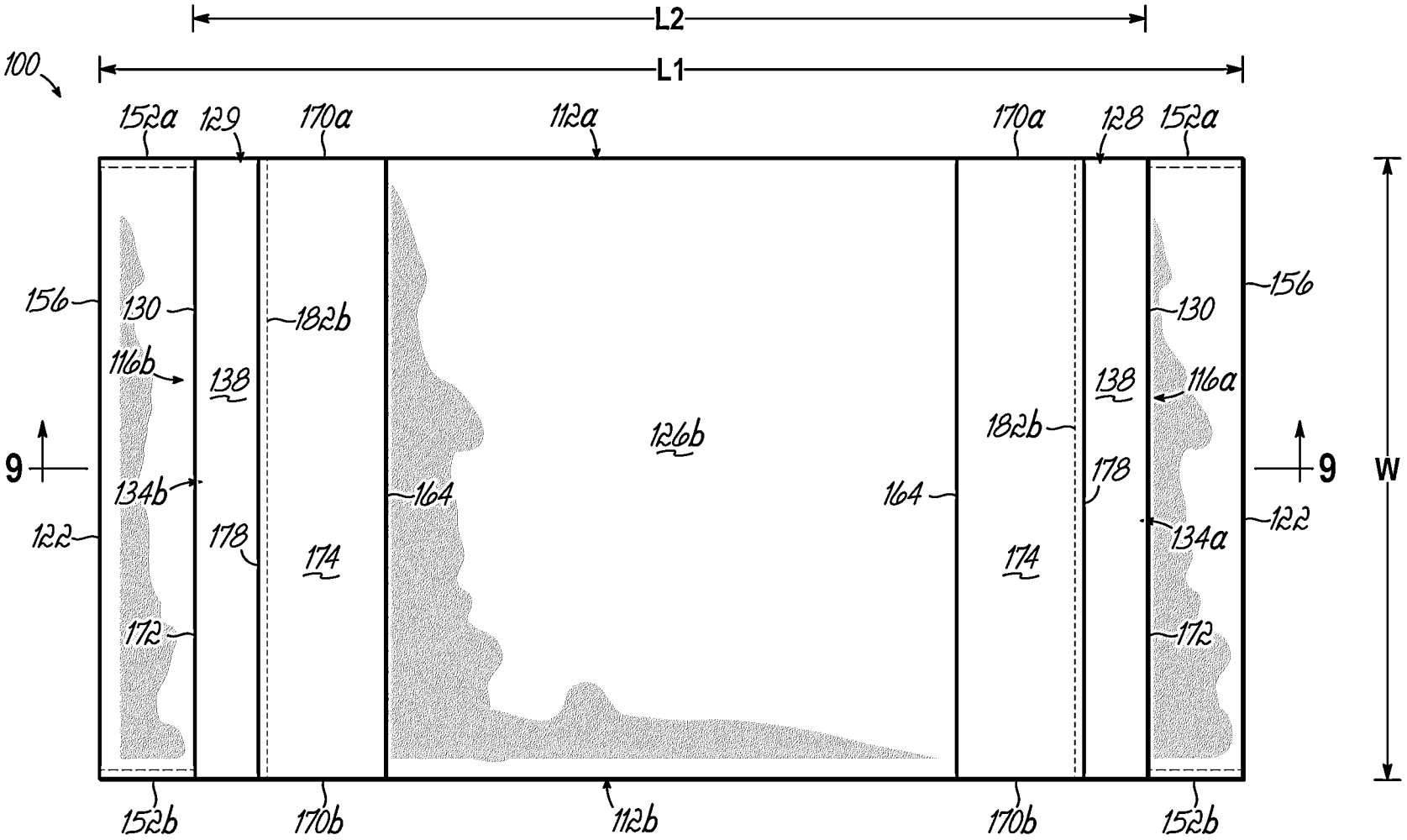
FIGS. 8A and 8B are top and bottom plan views, respectively, of a pillowcase in accordance with another embodiment of the invention.
Figure 8B:
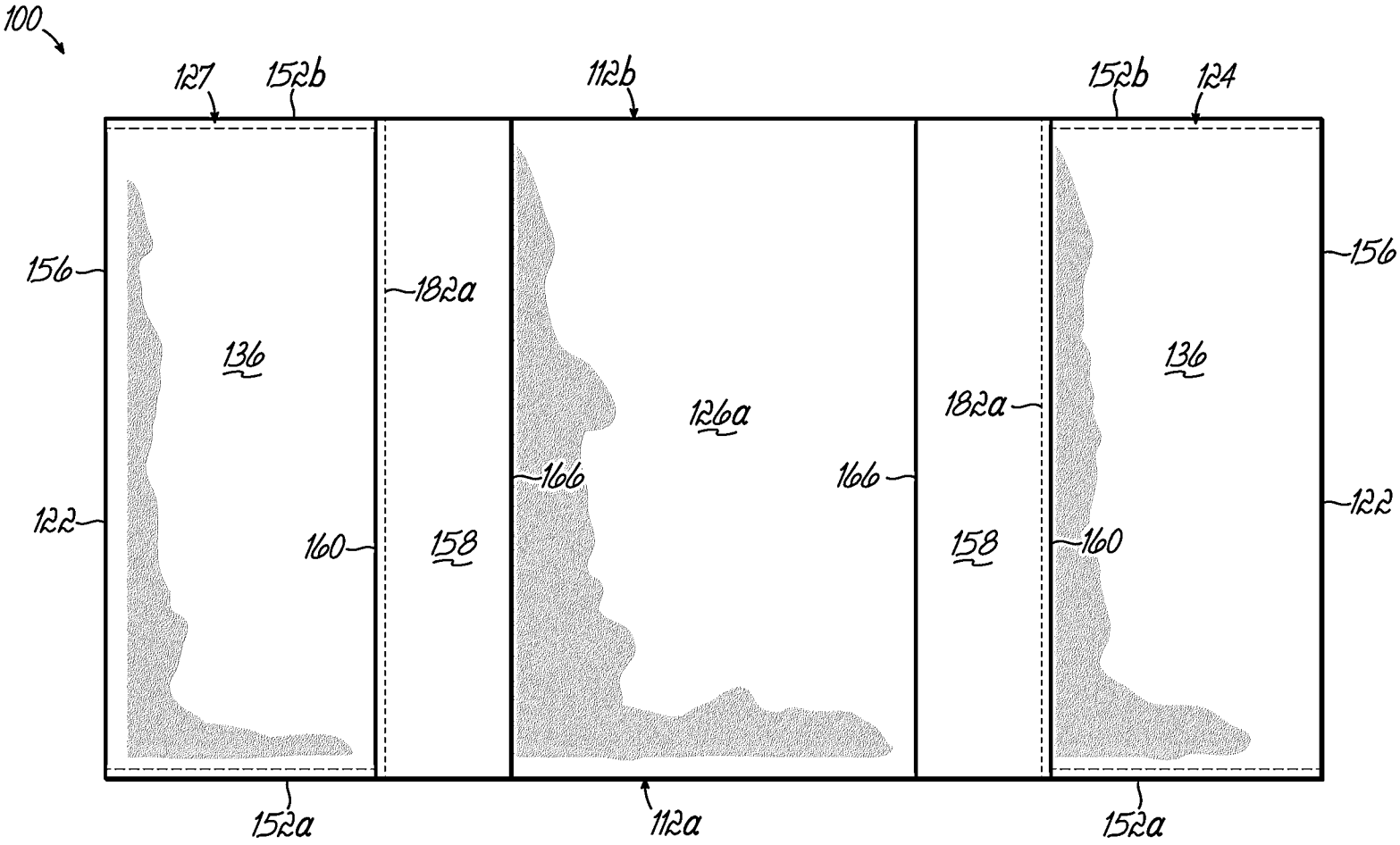
Figure 15:
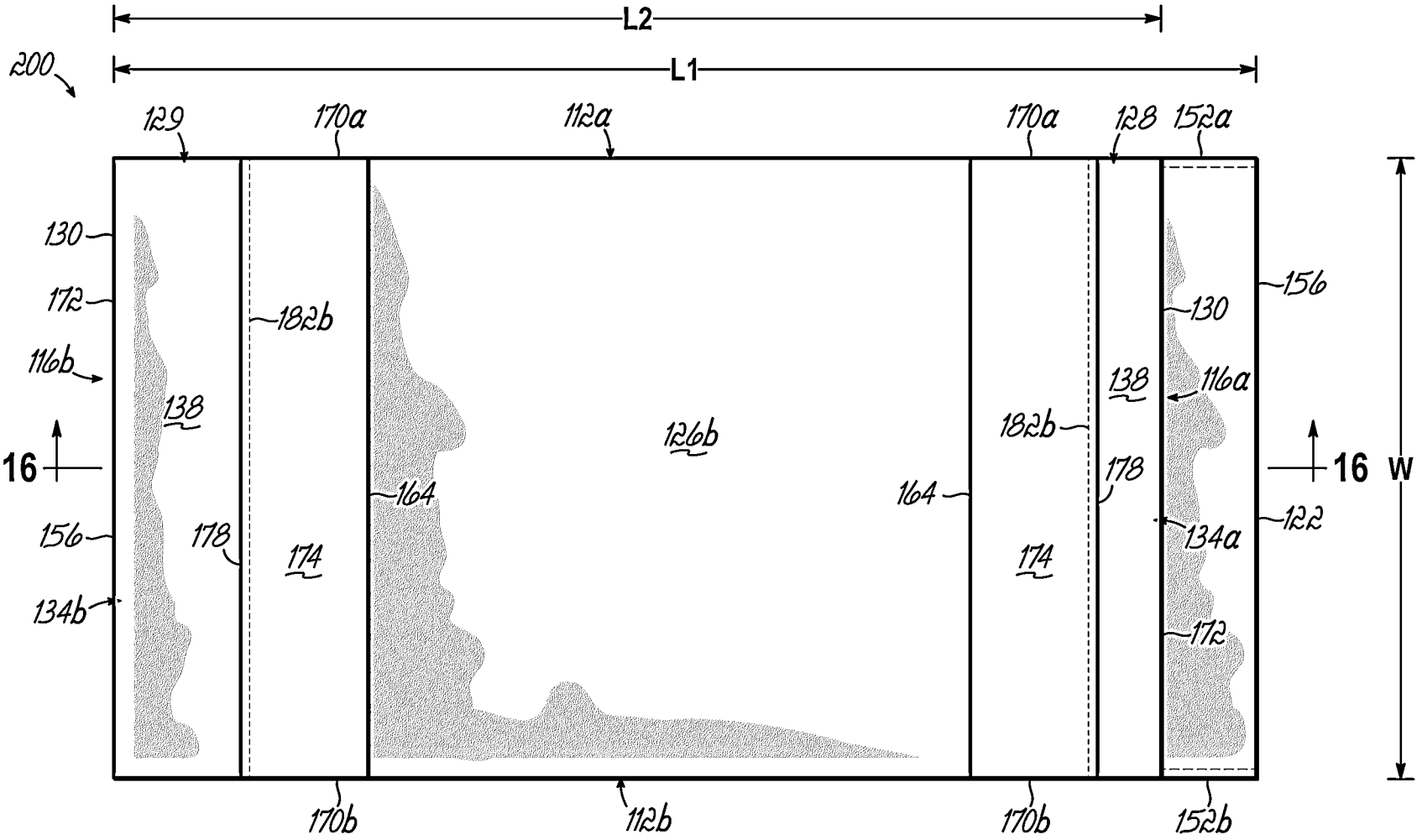
FIG. 15 is a top plan view of a pillowcase in accordance with another embodiment of the invention.
Figure 16:
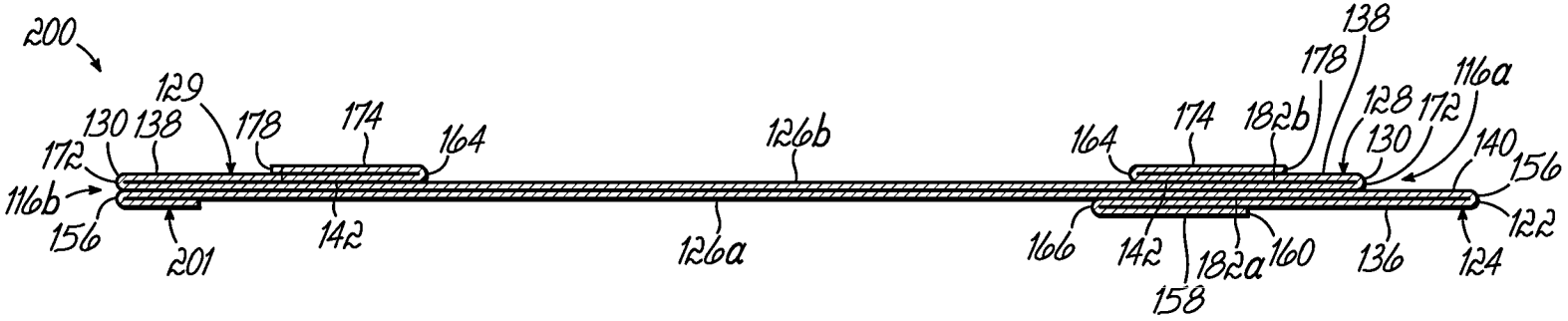
FIG. 16 is a cross-sectional view of the pillowcase of FIG. 15 taken along lines 16-16.

With reference now to FIGS. 15 and 16, a pillowcase 200 is shown in accordance with another embodiment of the invention that is a variation of the double open-ended pillowcase 100 of FIGS. 8A, 8B, and 9. With this pillowcase 200, the double open end construction has been modified to include only three of the four foldable flaps, i.e., only the first, second, and fourth foldable flaps 124, 128, and 129. That is, one side 126*a* of the pillowcase 200 at the open end 116*b* opposite the first foldable flap 124 has had its foldable flap 127 removed therefrom and includes a hem 201 sewn at an end thereof along its width by means and methods known in the art. It should be understood here that the first foldable flap 124 similarly can be removed instead of the third foldable flap 127. As shown, the fourth foldable flap 129 is situated about the second opening 134*b* at the second open end 116*b* thereof. And the terminal end 156 of the opposite side 126*a* of the pillowcase 200, which is without the third foldable flap 127, is generally aligned with the distal end 130 of the fourth foldable flap 129. While shown generally aligned, the terminal end 156 could be configured to fall short of or extend beyond the distal end 130 of the fourth foldable flap 129 whereby the opposite side 126*a* of the pillowcase 200 could be a little longer or shorter in length. With this pillowcase 200, the fourth foldable flap 129 can be folded over to close or cover the second open end 116*b* after a pillow, such as pillow 48, 50, has been inserted or received into the cavity 144, as discussed above.

An overall first length (L1) is defined here by the distance between the distal end 122 of the first foldable flap 124, which is situated on the first side 126*a* of the pillowcase 200 and that extends beyond the second foldable flap 128 on the second opposing side 126*b* of the pillowcase 200, and the distal end 130 of the fourth foldable flap, which is situated on the second side 126*b* of the pillowcase 200 and that is generally aligned with the terminal end 156 of the first side 126*a* of the pillowcase 200. Although shown on the second side 126*b* of the pillowcase 200, it should be understood that the fourth foldable flap 129 can be situated on either side 126*a*, 126*b* of the pillowcase 200, as desired. The pillowcase 200 further includes a second shorter length (L2) that is defined by the distance between the distal end 130 of the second foldable flap 128 and the distal end 130 of the fourth foldable flap 129, both of which are situated on the same side 126*b* of the pillowcase 200.

As discussed above with respect to pillowcase 100, for example, the openings 134*a*, 134*b* of the pillowcase 200 lead to cavity 144 into which pillow 48, 50 can be placed/received and ultimately retained therein by at least one of the first and fourth foldable flaps 124, 129 or second and fourth foldable flaps 128, 129 when folded over. Accordingly, like the pillowcase 100 of FIGS. 8A, 8B, and 9, this pillowcase configuration allows for receipt of two differently sized pillows 48, 50 generally corresponding to the first and second lengths (L1 and L2) and the width (W) of the pillowcase 200, which has been already discussed in detail above. Notably, the double open-ended construction allows one to reach into the pillowcase 200 from the first or second open end 116*a*, 116*b* opposite where the pillow 48, 50 is being inserted, and then grab and more easily pull the pillow 48, 50 through the other open end as compared to the traditional pushing or stuffing of the pillow 48, 50 from the one open end only.

Figure 17:
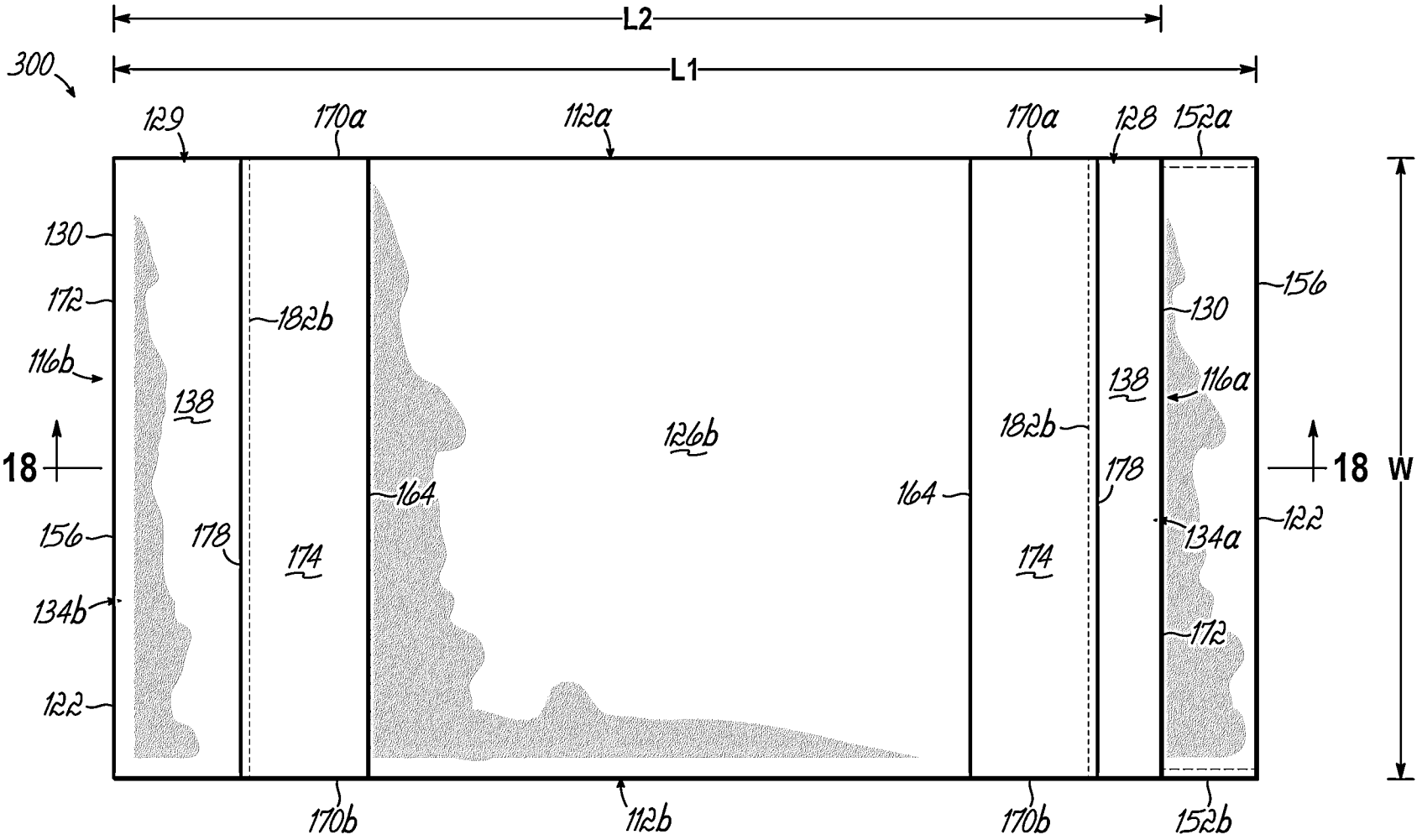
FIG. 17 is a top plan view of a pillowcase in accordance with another embodiment of the invention.
Figure 18:
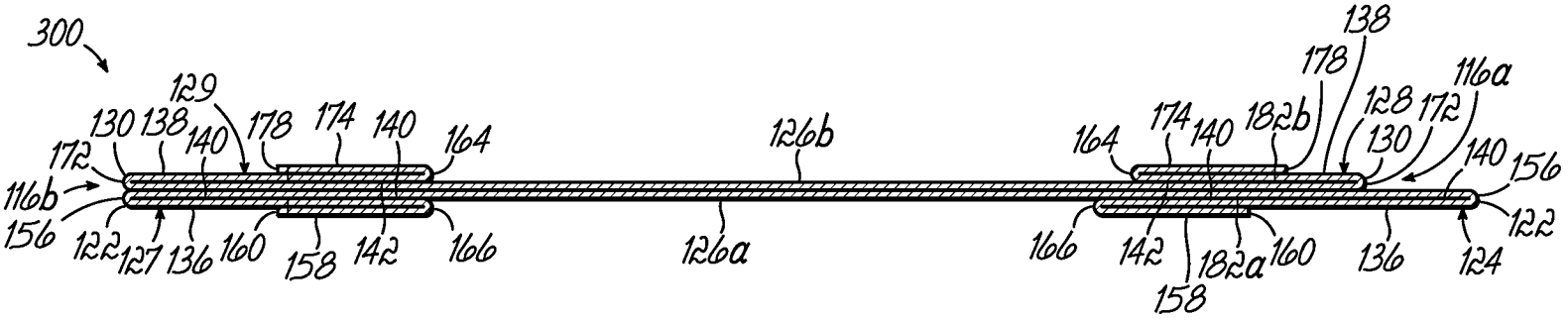
FIG. 18 is a cross-sectional view of the pillowcase of FIG. 17 taken along lines 18-18.

With reference now to FIGS. 17 and 18, a pillowcase 300 is shown in accordance with another embodiment of the invention that is a variation of the double open-ended pillowcase of FIGS. 8A, 8B, and 9. With this pillowcase 300, the distal ends 122, 130 of the third and fourth foldable flaps 127, 129 are generally aligned. As such, an overall first length (L1) is defined here by the distance between the distal end 122 of the first foldable flap 124, which is situated on the first side 126*a* of the pillowcase 300 and that extends beyond the second foldable flap 128 on the second opposing side 126*b* of the pillowcase 300, and the distal end 122, 130 of either of the third or fourth foldable flaps 127, 129. The pillowcase 300 further includes a second shorter length (L2) that is defined by the distance between the distal end 130 of the second foldable flap 128 and the distal end 122, 130 of either of the third or fourth foldable flaps 127, 129. With this configuration, either of the third or fourth flaps 127, 129 can be folded over to close the second end 116*b*.

As discussed above, the pillowcase 10, 100, 200, 300 can be constructed to accommodate both a king size pillow 48 and a queen size pillow 50. In another example, the sizing of the pillowcase 10, 100, 200, 300 can accommodate a standard size pillow and a queen size pillow. Still yet, the pillowcase 10, 100, 200, 300 may be constructed to accommodate a standard size pillow and a king size pillow, for example. And other variations/pillow sizes can be contemplated by one skilled in the art. In one example, the width W of the pillowcase 10, 100, 200, 300 can be about 20 inches, which generally accommodates the standard widths of standard, queen, and king size pillows, and the first length L1 can be about 36 inches and the second length L2 can be about 30 inches, which generally accommodates the standard lengths of a king and queen size pillow, respectively. In another example, the width W of the pillowcase can be about 20 inches, and the first length L1 can be about 30 inches and the second length L2 can be about 26 inches, which generally accommodates the standard lengths of a queen and standard size pillow, respectively. In another example, the width and/or length can be greater in size, including from 20.0 to 22.0 inches for the width, and 26.0 to 28.0, 30.0 to 32.0, and 36.0 to 38.0 inches for the respective lengths, for example, as desired/needed. Of course, it should be understood that any number of widths and lengths can be utilized, as desired/needed.

Concerning the hems 58, 74, 158, 174 for each flap 24, 28, 124, 127, 128, 129, these can vary in length, as desired. In one example, the hem 58, 74, 158, 174 can be about 1, 2, 3, 4, or 5 inches long. In another example, the hem length of each flap 24, 28, 124, 127, 128, 129 can be the same or different. In another example, the hem length can be longer than 5 inches or less than 1 inch, as desired. Alternatively, banding could be added to one or more flaps to replace the traditional hem using means and methods known in the art. Also, decorative stitching, piping, embroidery, or combinations thereof and the like can be used on one or more flaps and/or incorporated into the pillowcase 10, 100, 200, 300, as desired.

The pillowcase 10, 100, 200, 300 can be constructed of various materials such as conventional materials that are typically used in the construction of pillowcases. Fabric construction can be woven, non-woven, or knitted, or combinations thereof. In one example, the fabric construction is a woven plain weave. In another example, the weave is a Jacquard weave. The fabric material can include natural and/or synthetic fibers, as desired. In one example, the fabric can include polyester, cotton, nylon, acetate, Tencel (lyocell), viscose (rayon), polypropylene, spandex, blends or combinations thereof. In another example, the fabric includes polyester and/or cotton. Different types of fabrics may be utilized on the different sides 26*a*, 26*b*, 126*a*, 126*b* and/or flaps 24, 28, 124, 127, 128, 129 of the pillowcase 10, 100, 200, 300, as desired, resulting in different fabrics for the flaps 24, 28, 124, 127, 128, 129, for example. Also, different weaves could be utilized on the different sides 26*a*, 26*b*, 126*a*, 126*b*. In another example, the flaps 24, 28, 124, 127, 128, 129 themselves could be of a different fabric 26*a*, 26*b*, 126*a*, 126*b*. The fabric can be printed, striped, or patterned, for example. The fabric for the pillowcase 10, 100, 200, 300 can be essentially any desired color. In one example, the fabric color is white. In another example, the pillowcase 10, 100, 200, 300 can include or define a composite fabric where at least one layer, such as an additional layer, is constructed by lamination. For example, the pillowcase 10, 100, 200, 300 can be or include a laminated film.

The pillowcase 10, 100, 200, 300, such as the fabric thereof, can include one or more finishes, e.g., chemical finishes to provide a desired characteristic(s). The finishes can be applied by means and methods known in the art. Such finishes can include and/or provide softeners, stain release, repellency, scent/fragrance, anti-microbial, skin care (e.g., hyaluronic acid), flame retardancy, and the like.

Although the pillowcase 10, 100, 200, 300 is constructed without the need for any fasteners to retain the pillow 48, 50 within its cavity 54, 154, it is contemplated that one or more fasteners (not shown) could be utilized, as desired. For example, one or more fasteners could be installed to keep one or more flaps 24, 28, 124, 127, 128, 129 secured over their respective opening 34, 134*a*, 134*b*. Those fasteners could be, for example, buttons, Velcro (hook and loop), snaps, magnets, clasps, ties, and the like.

Although the pillowcase construction is shown generally rectangular/rectangular in shape, different shapes (as well as sizes) of the pillowcase is contemplated, such as square, for example.

Figure 1B:
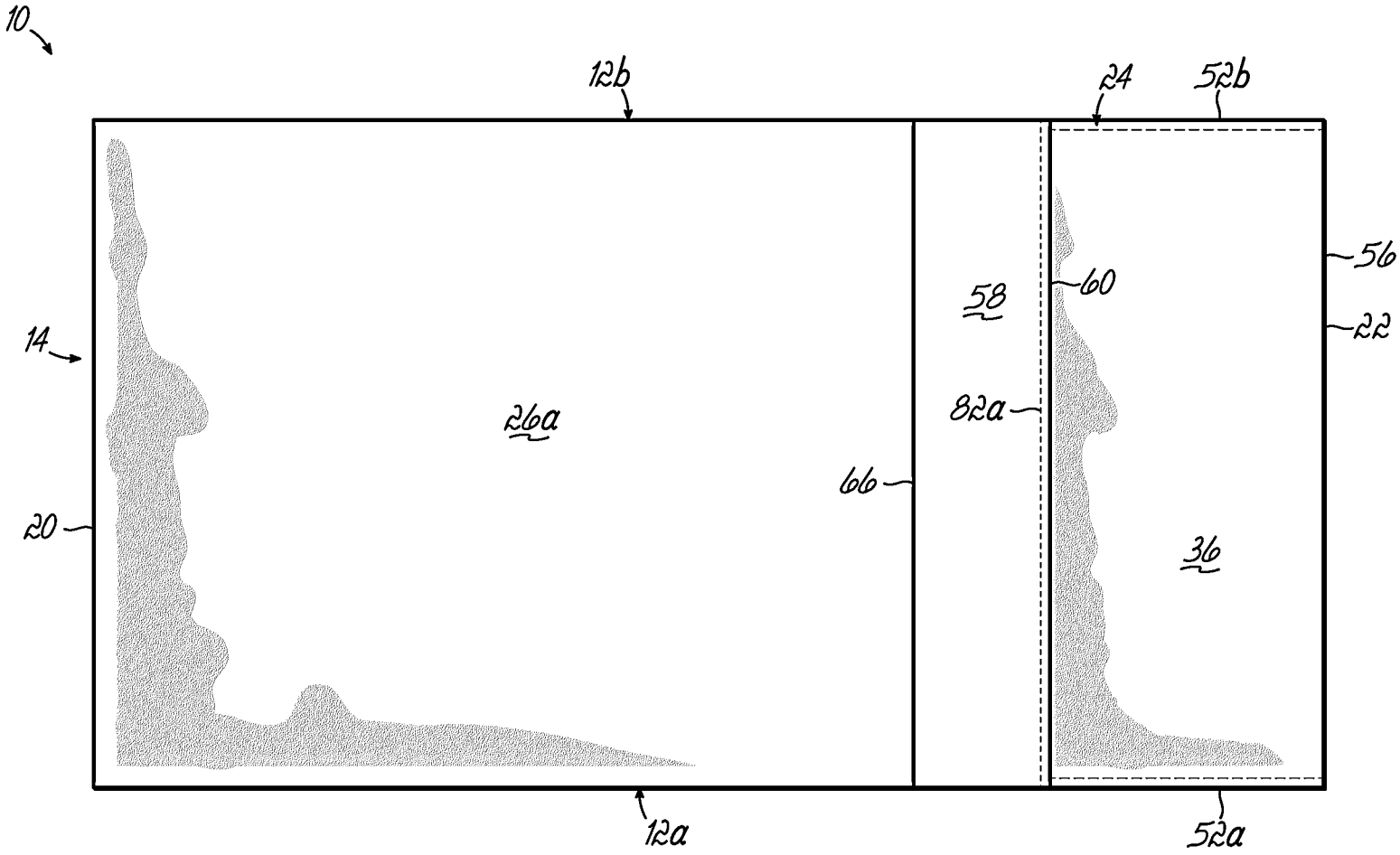
Figure 19:
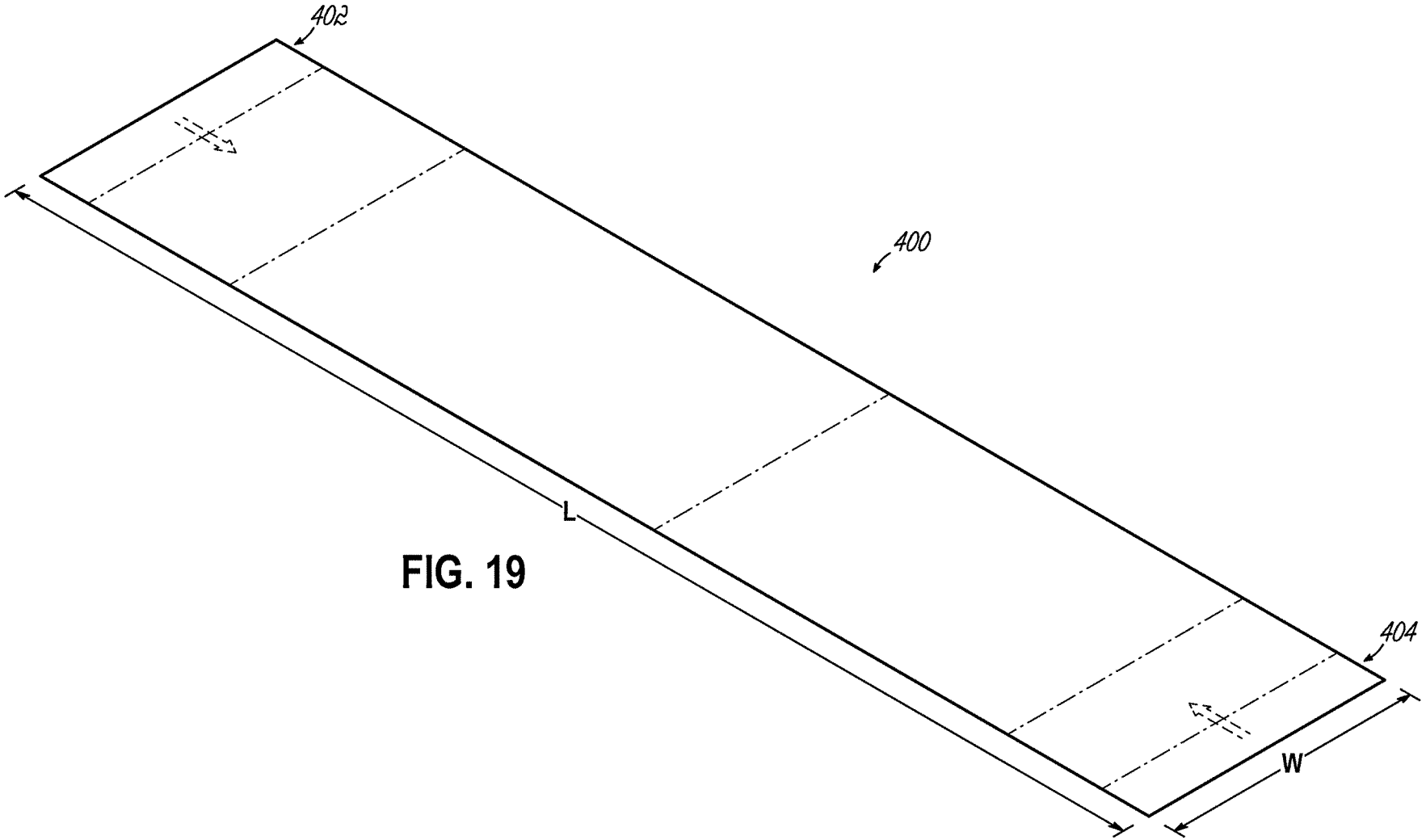
FIGS. 19-22 show a method of making of the pillowcase of FIG. 1 in accordance with an embodiment of the invention.
Figure 20:
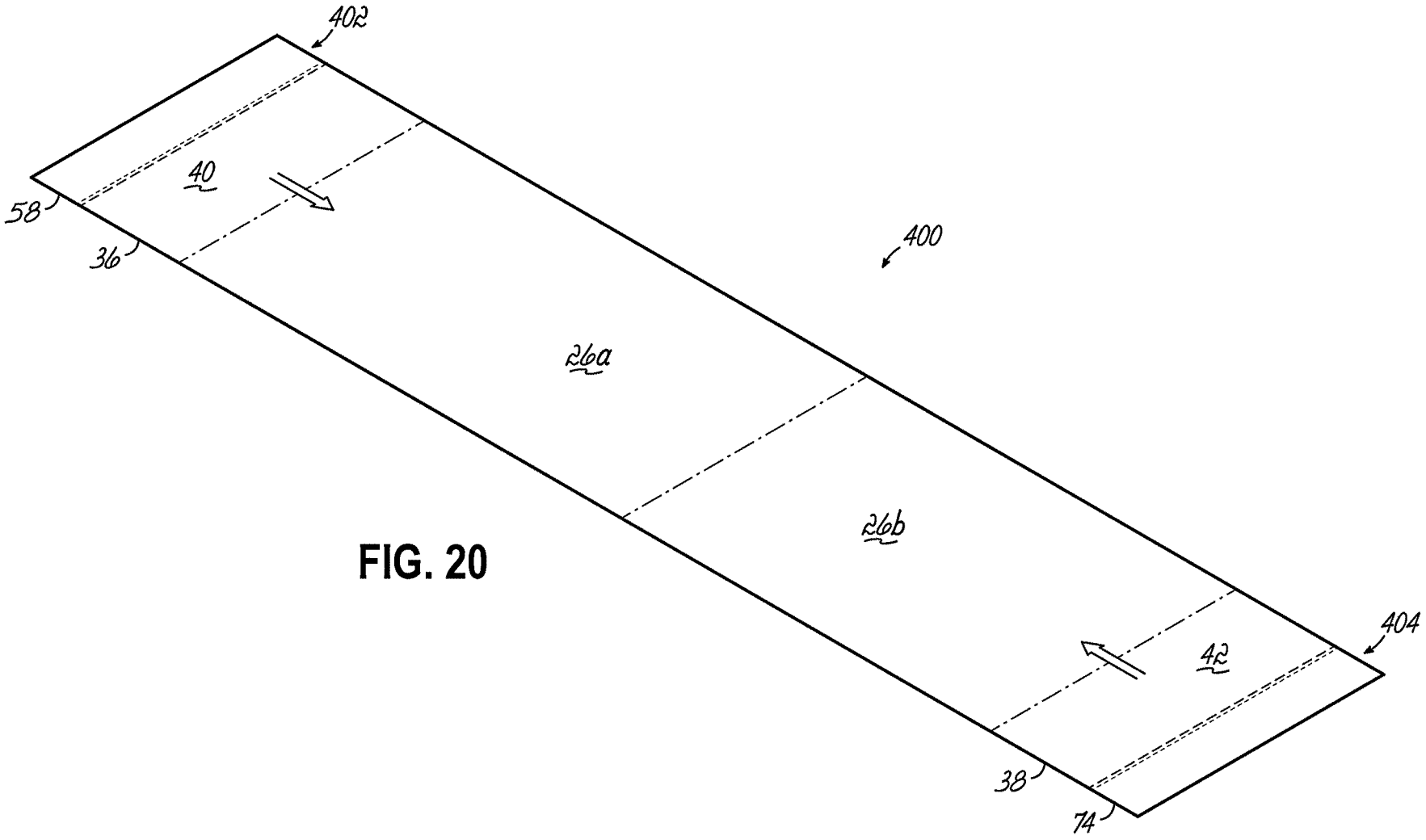
Figure 21:
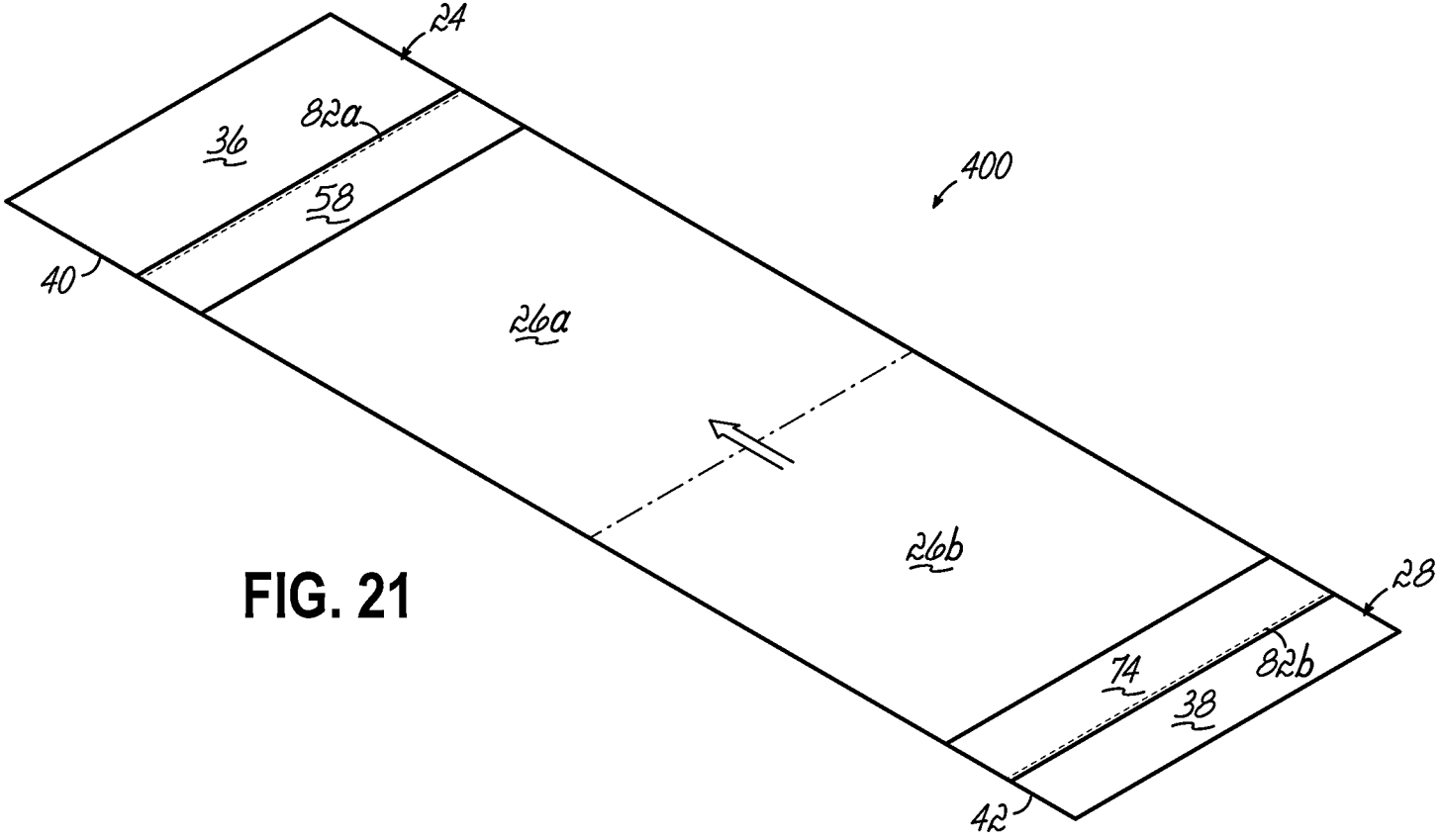

Concerning now manufacture of the pillowcase 10 and as it relates to the single open ended pillowcase construction of FIGS. 1A, 1B, and 2, for example, the pillowcase 10 can be made/cut from one continuous piece of fabric 400 as shown in FIGS. 19-22 and as described next. In one example, as best shown in FIGS. 19 and 20, the dimensions of the initial continuous piece of fabric can be 21×95 inches (width (W) and length (L)), although, it should be understood here that the initial size (W and/or L) can be varied as desired/needed. To create the pillowcase 10 for accommodating both the king size and a queen size pillow 48, 50, one can begin with sewing the hems 58, 74 for each of the first and the second foldable flaps 24 and 28 (FIG. 21). Here, the hems 58, 74 are created and situated on opposite ends 402 of the fabric 400 and created by means and methods known in the art. In particular, the king size or first foldable flap 24 and the queen size or second foldable flap 28, for example, can be sewn with 4 inch hems with a ½ inch turn under.

With further reference to FIGS. 20 and 21, the thread 82*a*, 82*b* for the hems can be color coded to match the first and second foldable flaps 24, 28 with its corresponding pillow size 48, 50. For example, the hem 58 of the first foldable flap 24 can be color coded using green thread, such as canton green, which would be visible on the outer surface 36 of the first foldable flap 24 for the king size pillow 48, and the hem 74 of the second foldable flap 28 can be color coded using blue thread, such as old China, which would be visible on the outer surface 38 of the second foldable flap 28 for the queen size pillow 50. In contrast, basic white thread can be used on the hems 58, 74 of the first and second foldable flaps 24, 28 to be visible on the inner surfaces 40, 42 of the first and second foldable flaps 24, 28 so that the color of the thread would not be readily visible when the flaps 24, 28 are folded over and in use for covering the opening to retain the corresponding pillow 48, 50.

Next, as best shown in FIGS. 20 and 21, a desired length of the opposite ends 402, 404 of the fabric 400, which includes each of the hems 58, 74, can be folded back over along its length L and across its width W onto the fabric 400 so as to create each of the first and second foldable flaps 24, 28 with the colored thread 82*a*, 82*b* being visible. In one example, one end 402 is folded over to provide the first foldable flap 24, which can be 12 inches in length including the hem 58, and the other end 404 is folded over to provide the second foldable flap 28, which can be 8 inches in length including the hem 74. It should be understood that the length of the first and second foldable flaps 24, 28 can be shorter or longer, as desired/needed, particularly depending on the initial size of the fabric 400. In one example, the first foldable flap 24 can be from 10-14 inches and the second foldable flap 28 can be from 6 to 10 inches.

Figure 22:
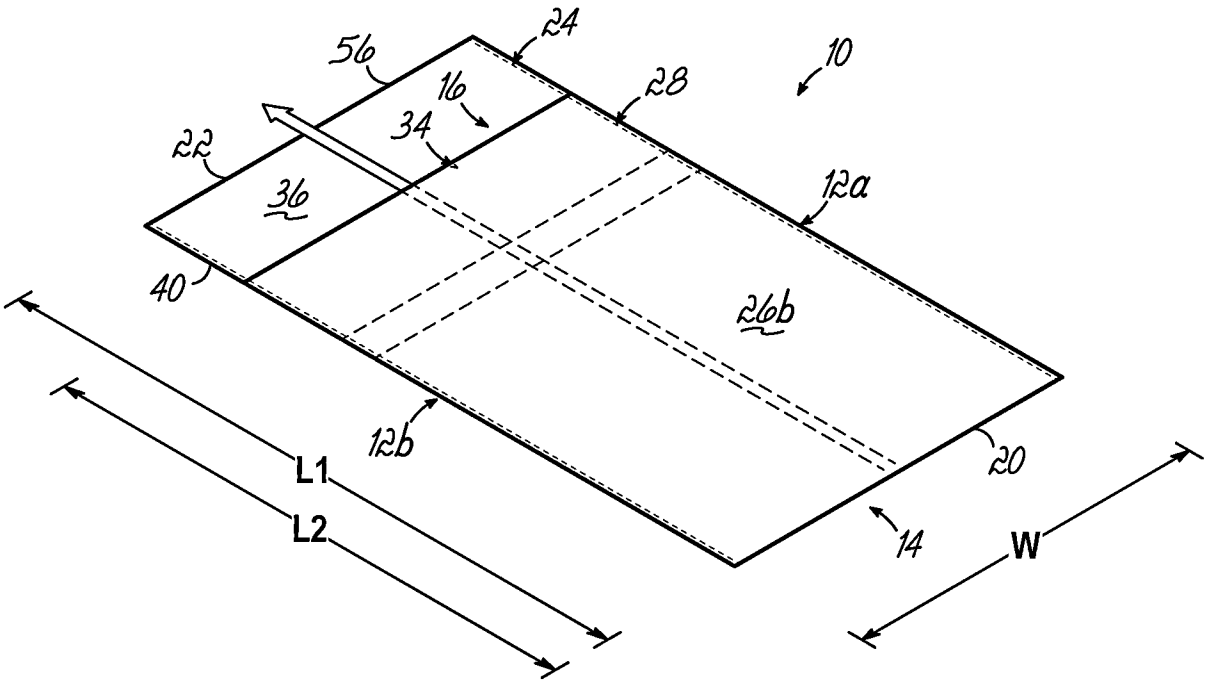

As shown in FIGS. 21 and 22, a length of the fabric 400 can be folded over along its length L and across its width W so that the side 26*a* with first foldable flap 24 and visible colored thread 82*a* can be overlapped in part and situated adjacent the side 26*b* with the second foldable flap 28. The side 26*a* with the first foldable flap 24 has the first length L1 of about 36 inches to correspond to the length of the king size pillow 48, and the side 26*b* with the second foldable flap 28 has the second length L2 of about 30 inches to correspond to the length of the queen size pillow 50. Next, as best shown in FIG. 22, the edges 12*a*, 12*b* of the pillowcase are stitched therealong including those of the closed end 14 by means and methods known in the art to secure the sides 26*a*, 26*b* of the pillowcase 10 thereto. In one example, the edges 2*a*, 12*b*, including those of the closed end 14, are serged, as known in the art, and bartacks (e.g., 4 bartacks) are provided adjacent the opening 34 by known means and methods. At this point, the pillowcase 10 is formed but is situated in an inside out position. FIGS. 1A and 1B show the pillowcase 10 right side out with FIG. 1A showing the side 26*b* of the pillowcase 10 with the second foldable flap 26 and FIG. 1B showing the side 26*a* of the pillowcase 10 with the first foldable flap 24.

Although shown as being manufactured from a single continuous piece of fabric, it should be understood that the pillowcase 10 with the single open end construction could be constructed from two or more pieces of fabric, if so desired.

Figure 23:
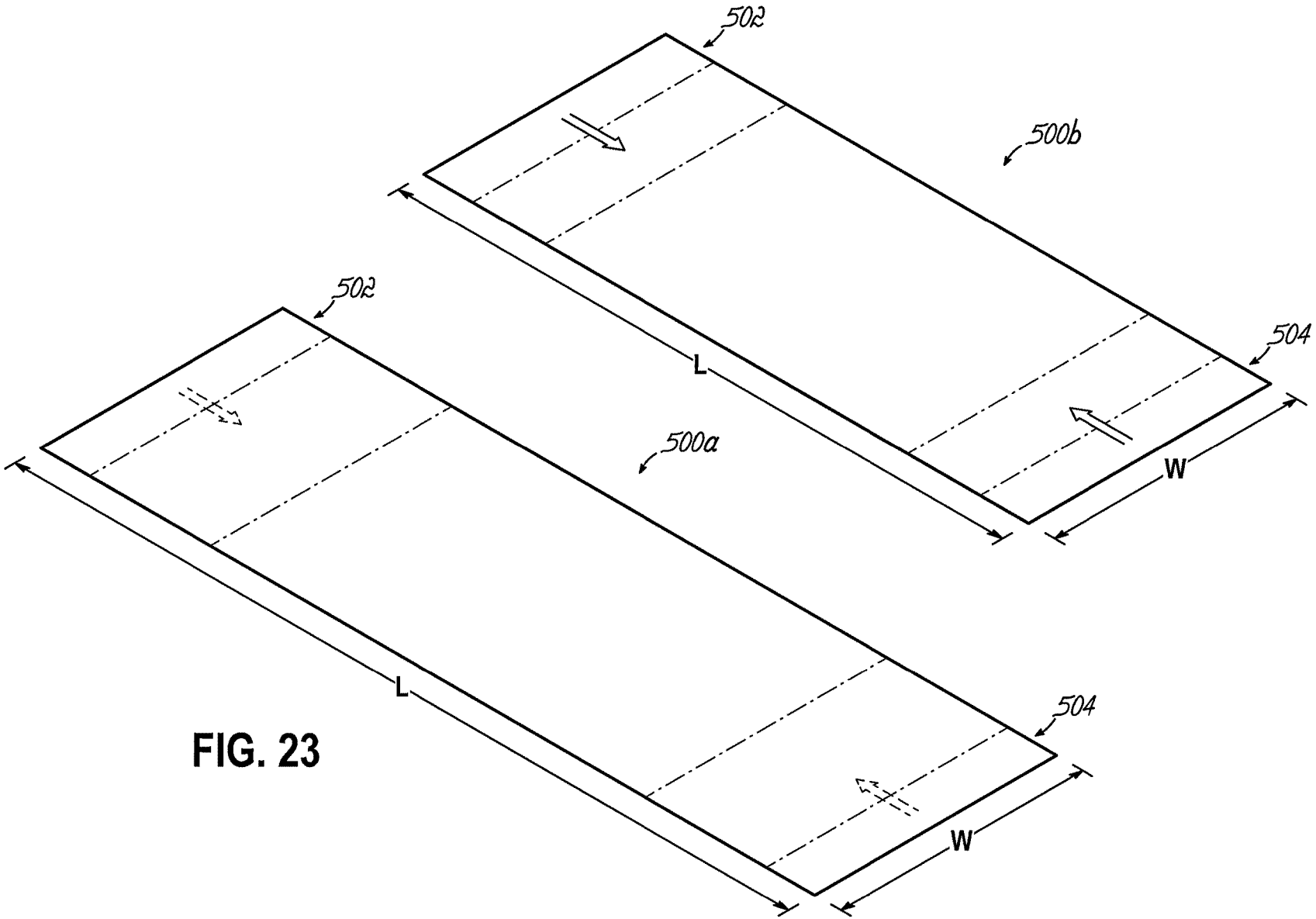
FIGS. 23-26 show a method of making of the pillowcase of FIGS. 8A and 8B in accordance with an embodiment of the invention.
Figure 24:
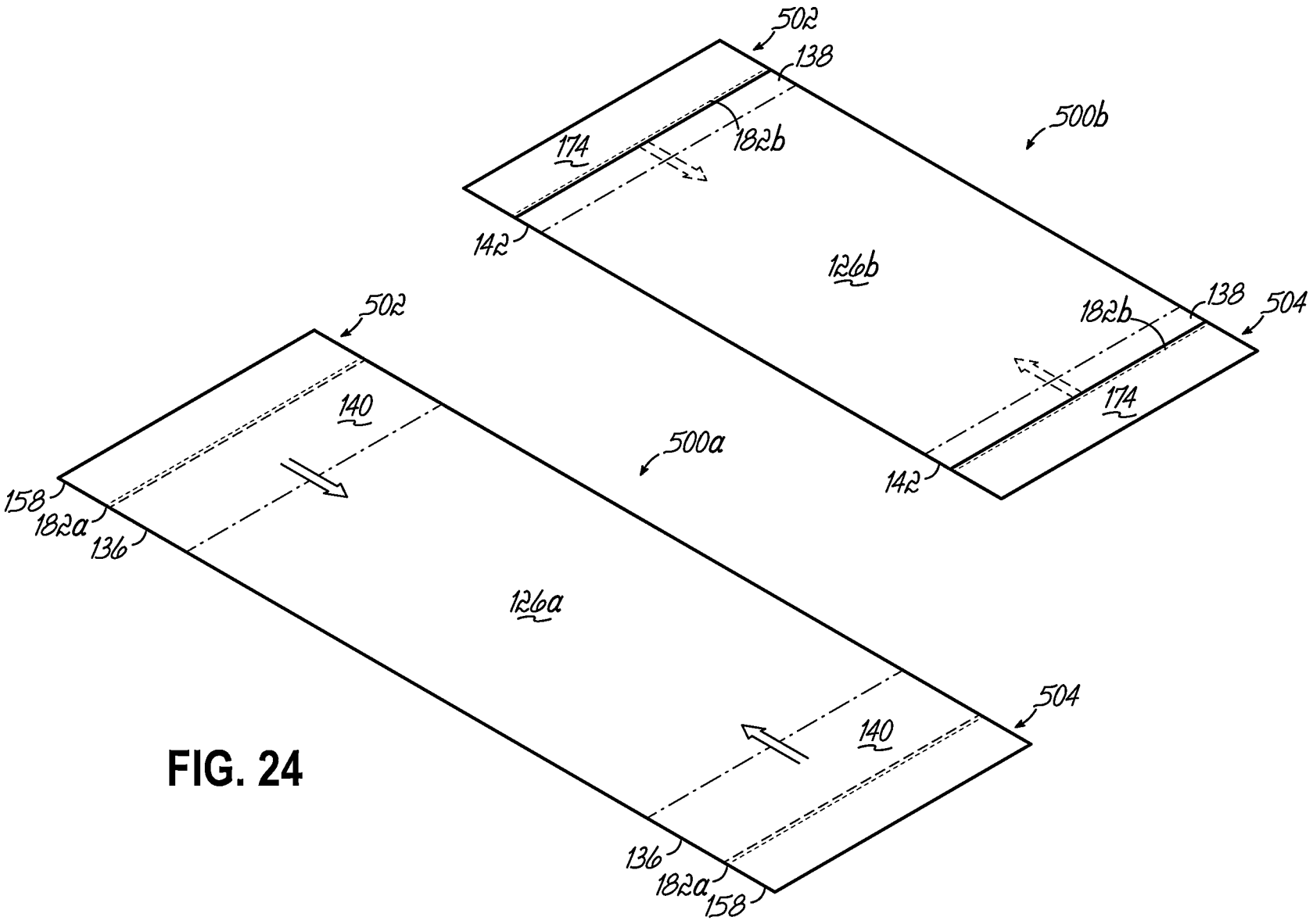
Figure 25:
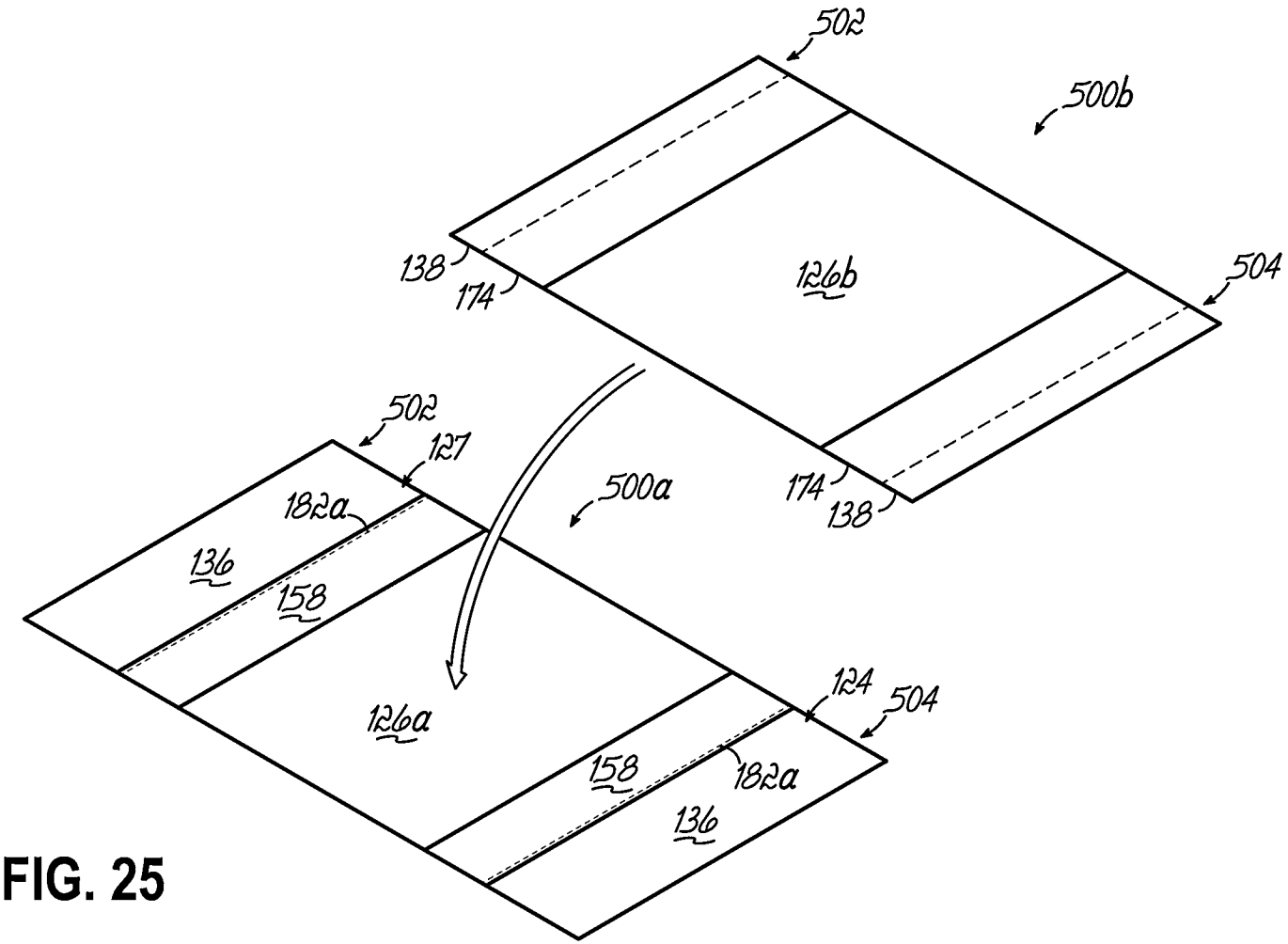

Concerning now manufacture of the pillowcase 100 and as it relates to the double open ended pillowcase construction of FIGS. 8A, 8B, and 9, for example, the pillowcase 100 can be made/cut from two continuous (separate) pieces of fabric 500*a* and 500*b* that are assembled and sewn together as shown in FIGS. 23-26 and as described next. In one example, as best shown in FIGS. 23 and 24, the dimensions of the first fabric piece 500*a* is about 21×65 inches (width (W)×length (L)) and of the second fabric piece 500*b* is about 21×51 inches (width (W)×length (L)), although, it should be understood here that the initial sizes (W and/or L) of the first and second fabric pieces 500*a*, 500*b* can be varied as desired/needed. To create the pillowcase 100 for accommodating both the king size and a queen size pillow 48, 50, one can begin with sewing the hems 158, 174 in the first and second fabric 500*a*, 500*b* for each of the first, second, third, and fourth foldable flaps 124, 127, 128, 129 (FIG. 25). Here, the hems are created and situated on opposite ends 502, 504 of the fabric 500*a*, 500*b* and created by means and methods known in the art. In particular, the first and third foldable flaps (the king size flaps) 124, 127 and second and fourth foldable flaps (the queen size flaps) 128, 129, for example, can be sewn with 4 inch hems with a ½ inch turn under.

With further reference to FIGS. 24 and 25, the thread 182*a*, 182*b* for the hems 158, 174 can be color coded to match the first and third foldable flaps 124, 127 and second and fourth foldable flaps 128, 129 with their corresponding pillow size 40, 50. For example, the hem 158 of the first and third foldable flaps 124, 127 can be color coded using green thread, such as canton green, which would be visible on the outer surface 136 of the first and third foldable flaps 124, 127 for a king size pillow 48, and the hem 174 of the second and fourth foldable flaps 128, 129 can be color coded using blue thread, such as old China, which would be visible on the outer surface 138 of the second and fourth foldable flaps 128, 129 for the queen size pillow 50. In contrast, basic white thread can be used on the hems 158, 174 of the first, second, third, and fourth foldable flaps 124, 127, 128, 129 to be visible on the inner surfaces 140, 142 thereof so that the color of the thread 182*a*, 182*b* would not be readily visible when the flaps 124, 127, 128, 129 are folded over and in use for covering the opening to retain the pillow.

Next, as best shown in FIGS. 24 and 25, a desired length of the opposite ends 502, 504 of each of the first and second fabrics 500*a*, 500*b*, which includes each of the hems 158, 174, respectively, can be folded back over along its length L and across its width W onto the fabric 500*a*, 500*b* so as to create each of the first and third foldable flaps 124, 127 on the first fabric 500*a* and the second and fourth foldable flaps 128, 129 on the second fabric 500*b* with the colored threads 182*a*, 182*b* being visible on the first and second fabric 500*a*, 500*b*. It should be appreciated here that the foldable flaps 124, 127, 128, 129 of each of the first and second fabrics 500*a*, 500*b* are facing each other in FIG. 25. In one example, each end 502, 504 of the first fabric 500*a* can be folded over to provide the first and third foldable flaps 124, 127, which can be 12 inches in length including the hem, and the ends 502, 504 of the second fabric 500*b* can be folded over to provide the second and fourth foldable flaps 128, 129, which can be 8 inches in length including the hem 158. It should be understood that the length of the foldable flaps 124, 127, 128, 129 can be shorter or longer, as desired/needed, particularly depending on the initial sizes of the first and second fabrics 500*a*, 500*b*. In one example, the first and third foldable flaps 124, 127 can be from 10-14 inches and the second and fourth foldable flaps 128, 129 can be from 6 to 10 inches.

As best shown in FIG. 25, the first and second fabrics 500*a*, 500*b* are placed against one another with the first and third foldable flaps 124, 127 and their colored thread 182*a* generally facing the second and fourth foldable flaps 128, 129 and their colored thread 182*b*. In one example, the longer first fabric 500*a* with its first and third foldable flaps 124, 127 can be about 36 inches in length thereby defining the first length L1 of the pillowcase 100 and which corresponds to the length of the king size pillow 48, and the shorter second fabric 500*b* with its second and fourth foldable flaps 128, 129 can be about 30 inches in length thereby defining the second length L2 and which corresponds to the length of the queen size pillow 50. Here, the second fabric 500*b* is shown being laid on top of the longer first fabric 500*a*. More specifically, the second fabric 500*b* is centered on top of the first fabric 500*b* so that about 3 inches of the first fabric 500*a* extend beyond each of the ends 502, 504 of the second fabric 500*b*.

Figure 26:
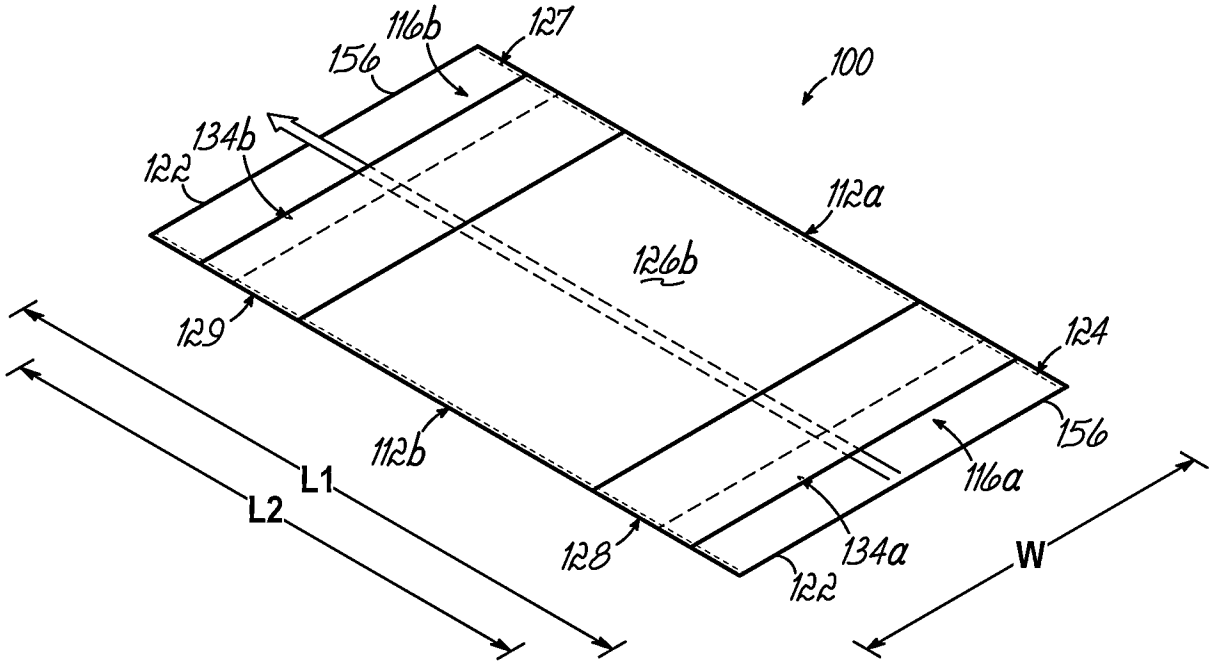

Next, as shown in FIG. 26, the edges 112*a*, 112*b* of each of the first and second fabric 500*a*, 500*b* can be stitched therealong by means and methods known in the art to secure the sides of the pillowcase 100 thereto. In one example, the edges 112*a*, 112*b* are serged, as known in the art, and bartacks (e.g., 8 bartacks with 4 bartacks on each side of the pillowcase) are provided adjacent the openings 134*a*, 134*b* by known means and methods. At this point, the pillowcase 100 is formed but is situated in an inside out position. FIGS. 8A and 8B show the pillowcase 100 right side out with FIG. 8A showing the side 126*b* of the pillowcase 100 with the second and fourth foldable flaps 128, 129 and FIG. 8B showing the side 126*a* of the pillowcase 100 with the first and third foldable flaps 124, 127.

Although shown as being manufactured from two separate and continuous pieces of fabric 500*a*, 500*b*, it should be understood that the pillowcase 100 with the double open end construction could be constructed from three or more pieces of fabric or from a single continuous piece of fabric (as explained next), if so desired. In addition, it should be understood that the same/similar techniques would/could be utilized here to make pillowcases 200, 300, which are variations of pillowcase 100.

In a variation of the manufacture of the pillowcase 100 and as it relates to the double open ended pillowcase construction of FIGS. 8A, 8B, and 9, for example, it should be understood that the pillowcase 100 can be made/cut from a single continuous piece of fabric. This variation is discussed relative to the manufacturing method illustrated in FIGS. 23-26. Here, the edges 112*a* of fabrics 500*a*, 500*b* could be continuous/connected along the length L2 of fabric 500*b* to provide/define a single continuous piece of fabric. Opposing slits are to be formed where the two fabrics 500*a*, 500*b* would be connected together and along the length of as-formed second and fourth foldable flaps 128, 129 of fabric 500*b* so that the hem 174 and second and fourth foldable flaps 128, 129 may be formed therein. The rest of the manufacturing method would be as discussed with respect to FIGS. 25 and 26 to provide pillowcase 100.

Further yet, although the bedding is shown and described herein in detail as a pillowcase 10, 100, 200, 300, one should understand that this concept could apply equally to a duvet cover (not shown), for example. That is, the above description, method of use, and method of manufacture with respect to the pillowcase (both a single open end and a double open end) could apply equally to a duvet cover for receiving and retaining a duvet, which could be considered an oversized pillowcase here. Along with pillowcases and duvets, other bedding to which this concept could apply equally includes pillow protectors and duvet insert protectors, for example, and the like.

Further concerning manufacturing of the pillowcase 10, 100, 200, 300, sewing methods as known in the art and as would be understood by those in the art can be employed to produce the pillowcase 10, 100, 200, 300. Also, welding (Rf, ultrasonic, heat, and the like) may be used, as desired, for manufacture of the pillowcase 10, 100, 200, 300.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described. Accordingly, departures may be made from such details without departing from the scope of applicant's general inventive concept.

What is claimed is:

1. A bedding comprising:

a generally rectangular shape with opposing edges extending along in parallel relationship, a closed end, and an open end opposite the closed end, a first length that is defined by the distance between an edge of the closed end of the bedding and a distal end of a first foldable flap, which is situated on a first side of the bedding and that extends beyond a second foldable flap on a second opposing and shorter side of the bedding, a second length that is shorter than the first length and defined by the distance between the same edge of the closed end and a distal end of the second foldable flap that is situated on the second opposing and shorter side of the bedding, the first and second foldable flaps are situated on the opposite first and second sides of the bedding, respectively, and about an opening at the open end, which is opposite the closed end and leads to a cavity into which a pillow or duvet can be received, each foldable flap overlaps a portion of each corresponding side by a desired length, the first foldable flap includes opposing edges that are aligned with the opposing edges of the bedding and are sewn together along a length of the desired length of the first foldable flap, the distal end of the first foldable flap is continuous with a terminal end of the first side of the bedding thereby defining a continuous hinge along the width of the bedding about which the first foldable flap can fold, and the second foldable flap includes opposing edges that are aligned with the opposing edges of the bedding and are sewn together along a length of the desired length of the second foldable flap, the distal end of the second foldable flap is continuous with a terminal end of the second side of the bedding, which is opposite that of the first foldable flap, thereby defining a continuous hinge along the width of the bedding about which the second foldable flap can fold, and wherein the bedding defines a single open-ended construction at the open end opposite the closed end in which the first foldable flap and the second foldable flap on one end of the bedding are configured to individually fold over the open end and one another, via their respective continuous hinge, to retain and hide therein one of a designated and different sized pillow or duvet dependent upon which foldable flap is folded.

2. The bedding of claim 1 wherein the bedding is a pillowcase that accommodates two different sized pillows wherein the second foldable flap when folded over accommodates one sized pillow and the first foldable flap when folded over accommodates a different sized pillow of a greater length.

3. The bedding of claim 2 wherein the two different sized pillows are a queen and a king size pillow or a queen and a standard size pillow.

4. The bedding of claim 1 wherein the bedding is a duvet cover that accommodates two different sized duvets wherein the second foldable flap when folded over accommodates one sized duvet and the first foldable flap when folded over accommodates a different sized duvet of a greater length.

5. The bedding of claim 4 wherein the two different sized duvets are a queen and a king size duvet or a queen and a standard duvet.

6. The bedding of claim 1 wherein a width of the bedding is generally uniform along the first and second lengths.

7. The bedding of claim 6 wherein the bedding can retain and hide therein one of a designated and different sized pillow or duvet that generally corresponds to the first and second lengths, respectively, and the width of the bedding.

8. The bedding of claim 1 wherein the first foldable flap is configured to lift up along the hinge formed by the intersection of the distal end of the first foldable flap and fold over a terminal end of the corresponding side of the bedding, and the second foldable flap includes a proximal edge that is situated below a proximal edge of the first foldable flap.

9. The bedding of claim 1 wherein the first foldable flap can include a colored yarn and the second foldable flap can include a different colored yarn to designate different sized pillows or duvets that each flap can accommodate.

10. A method of making a bedding comprising:

sewing a hem for each of a first and second foldable flap on opposite ends of a piece of fabric having a length and a width that is rectangular in shape;

thereafter, folding back over a desired length of the opposite ends of the fabric, which includes each of the hems, along its length and across its width onto the fabric so as to create each of the first and second foldable flaps;

thereafter, folding over along its length and across its width a length of the fabric so that a side with the first foldable flap can be overlapped in part and situated adjacent a side with the second foldable flap, wherein the side with the first foldable flap has a first length to generally correspond to a first pillow or first duvet, and the side with the second foldable flap has a second shorter length to generally correspond to a second different sized pillow or second duvet; and stitching along opposing edges of the fabric including those of a closed end to secure opposing sides of the fabric to form the bedding, which includes an open end having an opening opposite the closed end, and wherein the bedding is situated in an inside out position;

turning the bedding right side out, wherein the bedding defines a single open-ended construction at the open end opposite the closed end in which the first foldable flap and the second foldable flap on one end of the bedding is configured to individually fold over the open end and one another to retain and hide therein one of a designated and different sized pillow or duvet dependent upon which foldable flap is folded; and each foldable flap overlaps a portion of each corresponding side by a desired length, the first foldable flap includes opposing edges that are aligned with the opposing edges of the bedding and are sewn together along a length of the desired length of the first foldable flap, the distal end of the first foldable flap is continuous with a terminal end of the first side of the bedding thereby defining a continuous hinge along the width of the bedding about which the first foldable flap can fold, and the second foldable flap includes opposing edges that are aligned with the opposing edges of the bedding and are sewn together along a length of the desired length of the second foldable flap, the distal end of the second foldable flap is continuous with a terminal end of the second side of the bedding, which is opposite that of the first foldable flap, thereby defining a continuous hinge along the width of the bedding about which the second foldable flap can fold.

11. The method of claim 10 further comprising serging the opposing edges, including those of the closed end, and bartacking adjacent the opening.

12. The method of claim 10 wherein the bedding is manufactured from a single continuous piece of fabric.

13. The method of claim 10 wherein the bedding is a pillowcase that accommodates two different sized pillows wherein the second foldable flap when folded over accommodates one sized pillow and the first foldable flap when folded over accommodates a different sized pillow of a greater length.

14. The method of claim 10 wherein the bedding is a duvet cover that accommodates two different sized duvets wherein the second foldable flap when folded over accommodates one sized duvet and the first foldable flap when folded over accommodates a different sized duvet of a greater length.

15. The method of claim 10 wherein the first foldable flap can include a colored yarn and the second foldable flap can include a different colored yarn to designate different sized pillows or duvets that each flap can accommodate.

* * * * *